US007406852B2

(12) United States Patent
Otaki

(10) Patent No.: US 7,406,852 B2
(45) Date of Patent: Aug. 5, 2008

(54) UPSETTING METHOD AND UPSETTING APPARATUS

(75) Inventor: Atsushi Otaki, Oyama (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 11/342,498

(22) Filed: Jan. 31, 2006

(65) Prior Publication Data

US 2006/0260380 A1 Nov. 23, 2006

Related U.S. Application Data

(60) Provisional application No. 60/649,553, filed on Feb. 4, 2005.

(30) Foreign Application Priority Data

Jan. 31, 2005 (JP) ..... 2005-024121

(51) Int. Cl.
*B21D 22/16* (2006.01)

(52) U.S. Cl. ..... 72/359; 72/353.2

(58) Field of Classification Search ..... 72/358, 72/359, 353.2, 354.2, 354.6, 354.8, 355.2, 72/355.6, 394, 403, 453.02, 377
See application file for complete search history.

(56) References Cited

U.S. PATENT DOCUMENTS

2006/0260380 A1 11/2006 Otaki

FOREIGN PATENT DOCUMENTS

| | | | |
|---|---|---|---|
| JP | 48-062646 | | 9/1973 |
| JP | 09253782 | * | 9/1987 |
| JP | 5-76980 | | 3/1993 |
| JP | 5-104191 | | 4/1993 |
| JP | 09-253782 | | 9/1997 |
| JP | 2003-53470 | | 2/2003 |
| JP | 2003-053470 | * | 2/2003 |
| JP | 2003-290862 | | 10/2003 |

OTHER PUBLICATIONS

U.S. Appl. No. 10/566,467, filed Jan. 31, 2006, Otaki, et al.

* cited by examiner

*Primary Examiner*—Derris H. Banks
*Assistant Examiner*—Debra M Wolfe
(74) *Attorney, Agent, or Firm*—Oblon, Spivak, McClelland, Maier & Neustadt, P.C.

(57) ABSTRACT

An upsetting method capable of executing diameter expansion of a diameter expansion scheduled portion of a raw material unevenly in a peripheral direction is provided. A guide 20 having an insertion hole 21 for receiving and holding the diameter expansion scheduled portion 2 of the raw material 1 in a buckling preventing state is prepared. A diameter expansion preventing protruded portion 22 protruded in an axial direction of the guide 20 is integrally formed at a part of a tip end portion 20*a* of the guide 20. The diameter expansion scheduled portion 2 of the raw material 1 secured to the fixed die 10 is inserted and held in an insertion hole 21 of the guide 20. Subsequently the diameter expansion scheduled portion 2 of the raw material 1 exposed between the tip end portion 20*a* of the guide 20 and the fixed die 10 is expanded in diameter in a state in which diameter expansion of a contacting portion of the diameter expansion scheduled portion 2 in contact with the guide protruded portion 22 is restrained by moving the guide 20 in a direction opposite to a moving direction of the punch 30 while moving a punch 30 and pressurizing the diameter expansion scheduled portion 2 of the raw material 1 with the punch 30 in an axial direction.

16 Claims, 16 Drawing Sheets

UPSETTING METHOD AND UPSETTING APPARATUS

This application claims priority to Japanese Patent Application No. 2005-24121 filed on Jan. 31, 2005, and U.S. Provisional Application No. 60/649,553 filed on Feb. 4, 2005, the entire disclosures of which are incorporated herein by reference in their entireties.

CROSS REFERENCE TO RELATED APPLICATIONS

This application is an application filed under 35 U.S.C. §111(a) claiming the benefit pursuant to 35 U.S.C. §119(e)(1) of the filing date of U.S. Provisional Application No. 60/649,553 filed on Feb. 4, 2005, pursuant to 35 U.S.C. §111(b).

FIELD OF THE INVENTION

The present invention relates to an upsetting method and an upsetting apparatus for expanding a diameter of a prescribed portion of a bar-shaped raw material.

DESCRIPTION OF THE RELATED ART

In general, upsetting is executed to expand a diameter of a diameter expansion scheduled portion of a bar-shaped raw material by pressurizing the raw material in an axial direction. In this upsetting, if the raw material buckles at the time of the working, the obtained product (upsetting manufactured product) becomes poor in shape (e.g., wrinkles, scratches, etc.), which causes degradation in value as a product. Therefore, in order to prevent the occurrence of such buckling, the following upsetting method is conventionally known.

That is, in this method, a material is fixed in a fixed die, and the diameter expansion scheduled portion of the material is inserted into an insertion hole formed in a guide to thereby hold the diameter expansion scheduled portion in a buckling prevention state. Subsequently, the guide is moved in a direction opposite to a punch moving direction while pressurizing the diameter expansion scheduled portion of the material in the axial direction with a punch, to thereby radially expand the diameter expansion scheduled portion of the material exposed between the tip end portion of the guide and the fixed die (see Patent Documents 1 and 2).

In the aforementioned conventional upsetting method, normally, the diameter expansion scheduled portion of the material is expanded in diameter uniformly along the entire periphery thereof.

[Patent Document 1] Japanese Unexamined Laid-open Patent Publication No. S48-62646

[Patent document 2] Japanese Unexamined Laid-open Patent Publication No. H09-253782

DISCLOSURE OF THE INVENTION

[Problems to be Solved by the Invention]

The aforementioned conventional upsetting method is mainly used to manufacture a preform for industrial products. Some industrial products, such as, e.g., an arm member for automobiles or a connecting rod formed in the form of an eyeglass frame, are provided with connection portions expanded only at both lateral sides of the end portion of the shank. Furthermore, in a double-headed piston for compressors, the piston portions formed at both ends of the shank are shifted from the shank in central axis. In manufacturing a preform of such product by an upsetting method, there are the following problems.

That is, in the aforementioned upsetting method, the diameter expansion scheduled portion of the material is uniformly expanded along the entire periphery of the material as mentioned above, which requires additional machining to the diameter expanded portion, such as, e.g., a plastic deformation or cutting of the diameter expanded portion into a flat shape, so that the diameter expanded portion is formed into a shape of a connection portion or a piston portion after the upsetting. This causes problems, such as increased manufacturing steps or deteriorated yield.

The present invention was made in view of the aforementioned technical background, and aims to provide an upsetting method capable of unevenly expanding a diameter of a diameter expansion scheduled portion of a material in the peripheral direction thereof, an upsetting manufactured product obtained by the upsetting method, and an upsetting apparatus used for the upsetting method.

[Means to Solve the Problems]

The present invention provides the following means.

[1] An upsetting method using an upsetting apparatus provided with a fixed die for securing a bar-shaped raw material, a guide having an insertion hole for receiving and holding a diameter expansion scheduled portion of the raw material in a buckling preventing state, and a punch, wherein a diameter expansion preventing protruded portion protruded in an axial direction of the guide is integrally formed at a part of a tip end portion of the guide, the method comprises:

inserting and holding the diameter expansion scheduled portion of the raw material secured to the fixed die in the insertion hole of the guide; and subsequently expanding the diameter expansion scheduled portion of the raw material exposed between the tip end portion of the guide and the fixed die in a state in which diameter expansion of a contacting portion of the diameter expansion scheduled portion in contact with the diameter expansion preventing protruded portion is restrained by moving the guide in a direction opposite to a moving direction of the punch while moving the punch and pressurizing the diameter expansion scheduled portion of the raw material with the punch in an axial direction thereof.

[2] The upsetting method as recited in the aforementioned Item 1, wherein the fixed die is provided with a molding dented portion and a slide groove portion to be slidably inserted by the diameter expansion preventing protruded portion of the guide in an axial direction of the fixed die, the slide groove portion being formed on a peripheral surface of the molding dented portion extended in the axial direction of the fixed die, wherein a side surface of the protruded portion of the guide with which a part of a peripheral surface of the diameter expansion scheduled portion of the raw material comes into contact is formed into a surface corresponding to a peripheral surface of a diameter expanded portion of the raw material, wherein the diameter expansion scheduled portion of the raw material secured to the fixed die is placed in the molding dented portion, the diameter expansion scheduled portion of the raw material is inserted and held in the insertion hole of the guide, and the protruded portion of the guide is inserted in the slide groove portion, and wherein the diameter expansion scheduled portion of the raw material is subsequently expanded in the molding dented portion.

[3] The upsetting method as recited in the aforementioned Item 1 or 2, wherein "G" satisfies the following equation (i), $$G=(X_g-X)P/(L_0-X_P-Pt_0) \quad \text{(i)}$$

where "P" denotes an average moving speed of the punch from moving initiation thereof, "G" denotes an average moving speed of the guide from moving initiation thereof, "$X_0$" denotes a buckling limit length at a cross-sectional area of the diameter expansion scheduled portion of the raw material before executing the upsetting, "X" denotes an initial clearance between the tip end portion of the guide and the fixed die ($0 \leqq X \leqq X_0$), "$L_0$" denotes a length of the raw material before executing the upsetting required for the diameter expanded portion, "$X_P$" denotes a stop position of the tip end portion of the punch with respect to the fixed die, which is obtained from a design volume of the diameter expanded portion, "$X_g$" denotes a designed stop position of the tip end portion of the guide with respect to the fixed die, and "$t_0$" denotes a time lag from the moving initiation of the punch to the moving initiation of the guide ($0 \leqq t_0$).

[4] The upsetting method as recited in any one of the aforementioned Items 1 to 3, wherein the diameter expansion scheduled portion of the raw material is located at axial both side portions of the raw material, and wherein each diameter expansion scheduled portion of the raw material secured to the fixed die is inserted and held in the insertion hole of the guide, and thereafter both the diameter expansion scheduled portions of the raw material are simultaneously expanded in diameter by moving each guide in a direction opposite to the moving direction of the corresponding punch while simultaneously pressurizing each diameter expansion scheduled portion of the raw material with the punch in the axial direction.

[5] The upsetting method as recited in any one of the aforementioned Items 1 to 4, wherein an insertion hole opening edge portion of the tip end portion of the guide is chamfered.

[6] The upsetting method as recited in any one of the aforementioned Items 1 to 5, wherein an opening edge portion of a raw material fixing insertion hole formed at the fixed die is chamfered.

[7] The upsetting method as recited in any one of the aforementioned Items 1 to 6, wherein the raw material is a round bar-shaped rolled material.

[8] The upsetting method as recited in the aforementioned Item 7, wherein the raw material is a cast rolled material.

[9] The upsetting method as recited in the aforementioned Item 7, wherein the raw material is a continuously cast rolled material.

[10] The upsetting method as recited in any one of the aforementioned Items 7 to 9, wherein the diameter expansion scheduled portion of the raw material is expanded in diameter in a state in which lubricant is applied to a peripheral surface of the insertion hole of the guide and/or a surface of the diameter expansion scheduled portion of the raw material.

[11] The upsetting method as recited in any one of the aforementioned Items 1 to 10, wherein the diameter expansion scheduled portion of the raw material is expanded in diameter in a state in which a portion of the diameter expansion scheduled portion of the raw material corresponding to the tip end portion of the guide is partially heated.

[12] The upsetting method as recited in the aforementioned Item 11, wherein the portion of the diameter expansion scheduled portion of the raw material corresponding to the tip end portion of the guide is partially induction-heated by induction-heating means.

[13] The upsetting method as recited in the aforementioned Item 11, wherein the portion of the diameter expansion scheduled portion of the raw material corresponding to the tip end portion of the guide is partially heated by partially induction-heating the tip end portion of the guide by induction-heating means.

[14] The upsetting method as recited in any one of the aforementioned Items 11 to 13, wherein the portion of the diameter expansion scheduled portion of the raw material corresponding to the tip end portion of the guide is partially heated into a half-molten state.

[15] The upsetting method as recited in any one of the aforementioned Items 11 to 14, wherein the diameter expansion scheduled portion of the raw material is expanded in diameter in a state in which a portion of the diameter expansion scheduled portion of the raw material corresponding to a portion of the guide nearer the basal end side of the guide than the tip end portion of the guide by cooling means.

[16] An upsetting manufactured product obtained by the upsetting method as recited in any one of the aforementioned Items 1 to 15.

[17] An upsetting apparatus for executing diameter expansion of a diameter expansion scheduled portion of a bar-shaped raw material, the apparatus, comprising:

a fixed die for fixing the raw material;

a guide having an insertion hole for receiving and holding the diameter expansion scheduled portion of the raw material secured to the fixed die in a buckling preventing state;

a punch for pressurizing the diameter expansion scheduled portion of the raw material inserted in the insertion hole of the guide in an axial direction of the raw material; and a guide driving apparatus for moving the guide in a direction opposite to a moving direction of the punch, wherein a diameter expansion preventing protruded portion protruded in an axial direction of the guide is integrally formed at a part of a tip end portion of the guide, and wherein a part of a peripheral surface of the diameter expansion scheduled portion comes into contact with a side surface of the protruded portion at the time of executing diameter expansion of the diameter expansion scheduled portion of the raw material, whereby the protruded portion of the guide restrains diameter expansion of a contacting portion of the diameter expansion scheduled portion in contact with the protruded portion.

[18] The upsetting apparatus as recited in the aforementioned Item 17, wherein the fixed die has a molding dented portion, wherein a slide groove portion extended in an axial direction of the fixed die in which the protruded portion of the guide is to be slidably inserted in the axial direction of the fixed die is formed on the peripheral surface of the molding dented portion, and wherein the side surface of the protruded portion of the guide is formed into a surface corresponding to the peripheral surface of the diameter expanded portion of the raw material.

[19] The upsetting apparatus as recited in the aforementioned Item 17 or 18, wherein an insertion hole opening edge portion of the tip end portion of the guide is chamfered.

[20] The upsetting apparatus as recited in any one of the aforementioned Items 17 to 19, wherein an opening edge portion of a raw material fixing insertion hole formed at the fixed die is chamfered.

[21] The upsetting apparatus as recited in any one of the aforementioned Items 17 to 20, wherein the raw material is a round bar-shaped rolled material, and wherein the upsetting apparatus is further provided with a lubricant applying means for making lubricant adhere to a peripheral surface of the insertion hole of the guide and/or the surface of the diameter expansion scheduled portion of the raw material.

[22] The upsetting apparatus as recited in the aforementioned Item 21, wherein the rolled material is a cast rolled material.

[23] The upsetting apparatus as recited in the aforementioned Item 21, wherein the rolled material is a continuously cast rolled material.

[24] The upsetting apparatus as recited in any one of the aforementioned Items 17 to 23, further comprising heating means for partially heating a portion of the diameter expansion scheduled portion of the raw material corresponding to the tip end portion of the guide.

[25] The upsetting apparatus as recited in the aforementioned Item 24, wherein the heating means is induction-heating means having an induction-heating coil for partially induction-heating the portion of the diameter expansion scheduled portion corresponding to the tip end portion of the guide by the induction-heating means.

[26] The upsetting apparatus as recited in the aforementioned Item 24, wherein the heating means is induction-heating means having an induction-heating coil for partially heating the portion of the diameter expansion scheduled portion corresponding to the tip end portion of the guide by induction-heating the tip end portion of the guide by the induction-heating means.

[27] The upsetting apparatus as recited in the aforementioned Item 24, wherein the heating means is capable of partially heating the portion of the diameter expansion scheduled portion of the raw material corresponding to the tip end portion of the guide into a half-molten state.

[28] The upsetting apparatus as recited in any one of the aforementioned Items 24 to 27, further comprising cooling means for cooling a portion of the diameter expansion scheduled portion of the raw material corresponding to a portion of the guide nearer the basal end side of the guide than the tip end portion of the guide.

[29] An upsetting apparatus for expanding respective diameter expansion scheduled portions of both side portions of a bar-shaped raw material, the apparatus, comprising:

a fixed die for fixing the raw material;

two guides each having an insertion hole for receiving and holding each diameter expansion scheduled portion of the raw material secured to the fixed die in a buckling preventing state;

two punches for pressurizing each diameter expansion scheduled portion of the raw material inserted in the insertion hole of each guide in an axial direction; and two guide driving apparatuses for moving each guide in a direction opposite to a moving direction of the corresponding punch, wherein a diameter expansion preventing protruded portion protruded in an axial direction of the guide is integrally formed at a part of a tip end portion of at least one of two guides, and wherein a part of a peripheral surface of the diameter expansion scheduled portion comes into contact with a side surface of the protruded portion at the time of executing diameter expansion of the diameter expansion scheduled portion of the raw material, whereby the protruded portion of the guide restrains the diameter expansion of a contacting portion of the diameter expansion scheduled portion in contact with the protruded portion.

[30] The upsetting apparatus as recited in the aforementioned Item 29, wherein the fixed die has two molding dented portions, wherein a slide groove portion extended in an axial direction of the fixed die in which the protruded portion of the guide is to be slidably inserted in an axial direction of the fixed die is formed on a peripheral surface of at least one of the two molding dented portions, and wherein the side surface of the protruded portion of the guide is formed into a surface corresponding to the peripheral surface of the diameter expanded portion of the raw material.

[31] The upsetting apparatus as recited in the aforementioned Item 29 or 30, wherein an insertion hole opening edge portion of the tip end portion of each guide is chamfered.

[32] The upsetting apparatus as recited in any one of the aforementioned Items 29 to 31, wherein an opening edge portion of a raw material fixing insertion hole formed at the fixed die is chamfered.

[33] The upsetting apparatus as recited in any one of the aforementioned Items 29 to 32, wherein the raw material is a round bar-shaped rolled material, and wherein the upsetting apparatus is further provided with two lubricant applying means each for making lubricant adhere to the peripheral surface of the insertion hole of each guide and/or the surface of each diameter expansion scheduled portion of the raw material.

[34] The upsetting apparatus as recited in the aforementioned Item 33, wherein the rolled material is a cast rolled material.

[35] The upsetting apparatus as recited in the aforementioned Item 33, wherein the rolled material is a continuously cast rolled material.

[36] The upsetting apparatus as recited in any one of the aforementioned Items 29 to 35, further comprising two heating means each for partially heating a portion of the diameter expansion scheduled portion of the raw material corresponding to the tip end portion of each guide.

[37] The upsetting apparatus as recited in the aforementioned Item 36, wherein the heating means is induction-heating means having an induction-heating coil for partially induction-heating a portion of each diameter expansion scheduled portion corresponding to the tip end portion of the guide by the induction-heating means.

[38] The upsetting apparatus as recited in the aforementioned Item 36, wherein the heating means is induction-heating means having an induction-heating coil for partially heating a portion of each diameter expansion scheduled portion corresponding to the tip end portion of the guide by induction-heating the tip end portion of each guide by the induction-heating means.

[39] The upsetting apparatus as recited in any one of the aforementioned Items 36 to 38, wherein each heating means is capable of partially heating a portion of each diameter expansion scheduled portion of the raw material corresponding to the tip end portion of each guide into a half-molten state.

[40] The upsetting apparatus as recited in any one of the aforementioned Items 36 to 39, further comprising two cooling means each for cooling a portion of each diameter expansion scheduled portion of the raw material corresponding to a portion of each guide nearer the basal end side of the guide than the tip end portion of the guide.

[Effects of the Invention]

The present invention has the following effects.

In the invention as recited in the aforementioned Item [1], the diameter expansion scheduled portion of the raw material exposed between the tip end portion of the guide and the fixed die is expanded in diameter in a state in which a diameter expansion of a contacting portion of the diameter expansion scheduled portion in contact with the guide protruded portion is restrained by moving the guide in a direction opposite to a moving direction of the punch while moving a punch and pressurizing the diameter expansion scheduled portion of the raw material by this punch in an axial direction. Therefore, the diameter expansion scheduled portion of the raw material can be unevenly expanded in diameter in the peripheral direction. Therefore, it becomes possible to obtain a preform for manufacturing products, such as, e.g., an arm for automobiles, a connecting rod, a double-headed piston for compressors, or crankshaft, which is similar to the final product in shape as close as possible. Consequently such product can be manufactured with sufficient yield.

In the invention as recited in the aforementioned Item [2], since a side surface of the protruded portion of the guide is formed into a surface corresponding to the peripheral surface of a diameter expanded portion of the raw material, the diameter expanded portion of the raw material can be assuredly formed into a designed shape, and therefore a preform closer to a final product in shape can be obtained.

In the invention as recited in the aforementioned Item [3], it is possible to expand the diameter expansion scheduled portion of the raw material into a designed shape assuredly by a mechanical calculation by setting the initial clearance below the buckling limit length and adjusting the traveling speed of the punch and that of the guide so as to make the punch move end time for molding the amount of design and the guide move end time required to mold the diameter expanded portion of the amount of design coincide with each other.

In the invention as recited in the aforementioned Item [4], a preform in which a diameter expanded portion is formed at each of the axial both side portions can be manufactured efficiently.

In the invention as recited in the aforementioned Item [5], the back pressure of the material of the raw material is applied to the tip end portion of the guide effectively at the time of the working. Consequently, the driving force required to move the guide can be decreased.

In the invention as recited in the aforementioned Item [6], the stress concentration which may sometimes be generated at an angle portion of the raw material located between the portion secured to the fixed die and the diameter expanded portion can be reduced.

In the invention as recited in the aforementioned Item [7], since the round bar-shaped raw material made of a rolled material can be obtained at low cost, it is possible to reduce the working cost by using this raw material as an upsetting raw material.

Furthermore, in general, this raw material is low in circularity as compared with a round bar-shaped raw material made of an extruded material. Therefore, when the diameter expansion scheduled portion of this raw material is inserted in the insertion hole of the guide, a gap will be inevitably generated between the surface of the diameter expansion scheduled portion of the raw material and the peripheral surface of the insertion hole. Therefore, the contact surface thereof is small, and therefore the frictional resistance force at the time of slidably moving the diameter expansion scheduled portion of the raw material in the insertion hole in the axial direction is small, resulting in a reduced molding pressure. Consequently, it is possible to use a small punch driving apparatus for moving the punch, which in turn can save the installation space for the upsetting apparatus.

Furthermore, since the molding pressure can be reduced, there are following advantages. Namely, if the molding pressure is large, the end portion of the diameter expansion scheduled portion of the raw material may be often crushed within the insertion hole of the guide by the pressurizing force by the punch. In such case, some material of the diameter expansion scheduled portion of the raw material is introduced into the gap between the peripheral surface of the punch and the peripheral surface of the insertion hole. Consequently, the molding pressure increases. As a result, it becomes impossible for the punch to move within the insertion hole in the pressure direction, resulting in unworkablle. Thus, by reducing the molding pressure, such a problem can be solved. This enables the upsetting of the raw material in a preferable manner along the long region.

In the invention as recited in the aforementioned Item [8], the raw material made of a cast rolled material can be obtained or manufactured at lower cost. Therefore, by using this raw material as a raw material for upsetting, the working cost can be further reduced.

In the invention as recited in the aforementioned Item [9], since the raw material made of a continuously cast rolled material can be obtained or manufactured at lower cost, by using this raw material as a raw material for upsetting, the working cost can be further reduced.

The invention as recited in the aforementioned Item [10] has the following effects. That is, as mentioned above, since the round bar-shaped raw material made of a rolled material is low in circularity, if the diameter expansion scheduled portion of this raw material is inserted into the insertion hole of the guide, a gap will be produced inevitably between the surface of the diameter expansion scheduled portion of the raw material and the peripheral surface of the insertion hole. In cases where lubricant is adhering to the peripheral surface of the insertion hole and/or the surface of the diameter expansion scheduled portion of the raw material, the lubricant is introduced into this gap and retained temporarily. This enhances the application of the lubricant to the peripheral surface of the insertion hole and the surface of the diameter expansion scheduled portion of the raw material. That is, in accordance with the axial sliding movement of the diameter expansion scheduled portion in the insertion hole at the time of working, the lubricant in the gap is spread onto the peripheral surface of the insertion hole and the surface of the diameter expansion scheduled portion of the raw material. As a result, the frictional-resistance force between the peripheral surface of the insertion hole and the surface of the diameter expansion scheduled portion of the raw material can be reduced assuredly, namely, the molding pressure can be reduced assuredly.

In the invention as recited in the aforementioned Item [11], since the deformation resistance is partially reduced at the portion of the diameter expansion scheduled portions of the raw material corresponding to the tip end portion of the guide, the molding pressure can be reduced. On the other hand, since the portion of the diameter expansion scheduled portion of the raw material corresponding to a portion nearer the basal end side than the tip end portion of the guide is not heated, the deformation resistance cannot be reduced. Therefore, an increase in molding pressure produced when the diameter expansion scheduled portion of the raw material is expanded radially outwardly in the insertion hole of the guide by the pressurizing force from the punch can be prevented. Furthermore, it becomes possible to prevent an increase in molding pressure caused by an introduction of some material of the diameter expansion scheduled portion of the raw material into the gap between the peripheral surface of the punch and the peripheral surface of the insertion hole.

In the invention as recited in the aforementioned Item [12], the portion of the diameter expansion scheduled portion of the raw material corresponding to the tip end portion of the guide can be heated assuredly very efficiently.

In the invention as recited in the aforementioned Item [13], the portion of the diameter expansion scheduled portion of the raw material corresponding to the tip end portion of the guide can be heated assuredly in an efficient manner.

In the invention as recited in the aforementioned Item [14], the molding pressure can be reduced significantly.

In the invention as recited in the aforementioned Item [15], it is possible to assuredly prevent the heating of the portion of the diameter expansion scheduled portion of the raw material corresponding to the portion nearer the basal end side than the tip end portion of the guide.

In the invention as recited in the aforementioned Item [16], an upsetting manufactured product in which the diameter expansion scheduled portion of the raw material is expanded in diameter unevenly in the peripheral direction can be provided. This upsetting manufactured product can be suitably used as a preform for industrial products, such as, e.g., an arm for automobile, a connecting rod, a double-headed piston for compressors, a crankshaft.

In the invention as recited in the aforementioned Items [17] to [40], an upsetting apparatus which can be used suitably for the upsetting method according the aforementioned present invention can be provided.

DETAILED DESCRIPTION OF THE PREFERRED EMBODIMENTS

Next, some embodiments of the present invention will be explained below with reference to drawings.

FIGS. 1 to 5 are schematic views for explaining an upsetting method using an upsetting apparatus according to a first embodiment of the present invention.

Figure 1:
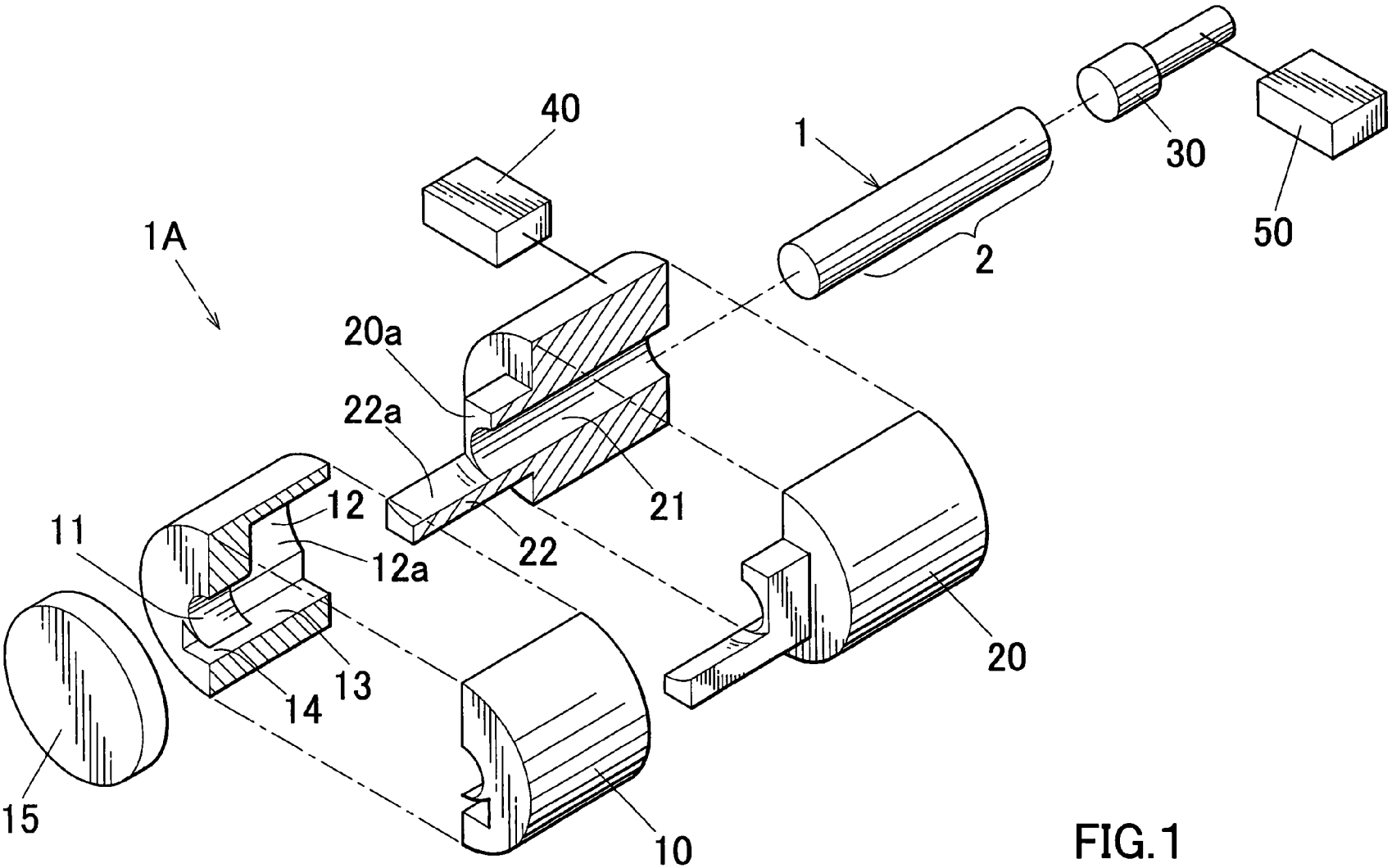
FIG. 1 is a schematic exploded perspective view of the principal part of the upsetting apparatus according to a first embodiment of the present invention.

In FIG. 1, "1A" denotes an upsetting apparatus according to a first embodiment, and "1" denotes a raw material. Moreover, in FIG. 5, "6A" denotes an upsetting manufactured product manufactured by the upsetting apparatus 1A. This upsetting manufactured product 6A is used as a preform for manufacturing, e.g., a part of a double-headed piston for compressors.

As shown in FIG. 1, the raw material 1 is a straight bar-shaped member made of, e.g., aluminum (including its alloy, hereinafter simply referred to as "aluminum). The raw material 1 is round in cross-section and constant in cross-sectional area along the axial direction.

In the present invention, the material of the raw material 1 is not limited to aluminum, and can be metal, such as, e.g., brass, copper, or stainless steel, or plastic. Furthermore, the cross-sectional shape of the raw material 1 can be polygonal, such as, e.g., square or hexagonal. The raw material 1 can be a rolled material or an extruded material, and also can be a material manufactured by other methods.

Figure 5:
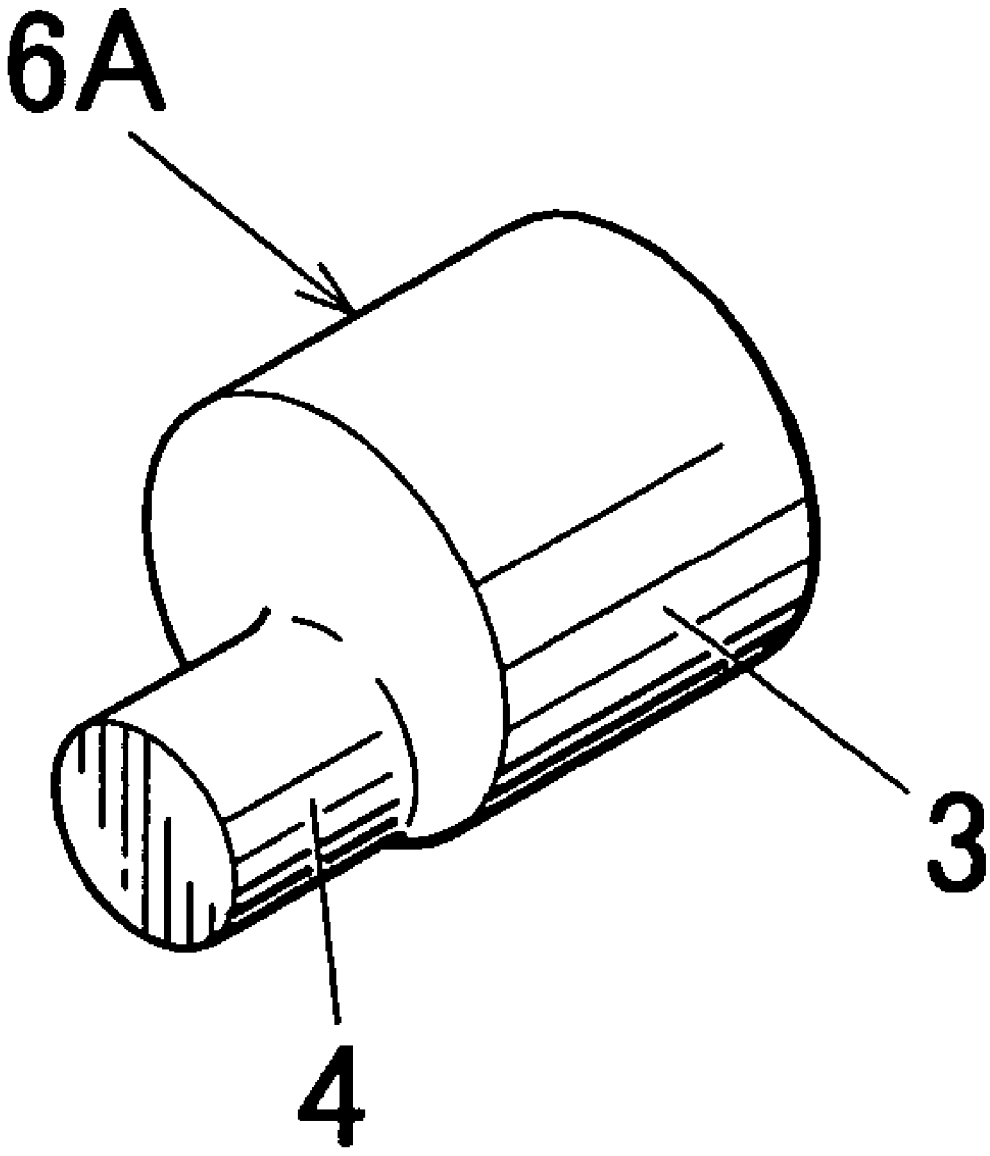
FIG. 5 is a perspective view showing an upsetting manufactured product obtained by the upsetting apparatus.

The diameter expansion scheduled portion 2 of this raw material 1 is located at one of both axial end portions of the raw material 1. More specifically, it is located at one end portion of the raw material 1. That is, the one end portion of the raw material 1 corresponds to the diameter expansion scheduled portion 2. When this diameter expansion scheduled portion 2 is expanded into the designed shape, as shown in FIG. 5, a cylindrical diameter expanded portion 3 is formed at one end portion of the raw material 1 (shank 4). The central axis of this diameter expanded portion 3 is shifted with respect to the central axis of the raw material 1. Therefore, the diameter expansion scheduled portion 2 of the raw material 1 is expanded in diameter unevenly in the peripheral direction.

In the present invention, expanding the diameter of each diameter expansion scheduled portion 2 of the raw material 1 unevenly in the peripheral direction means that the diameter expansion scheduled portion 2 is formed to have an uneven thickness by upsetting. For example, it means that only a part of the peripheral surface of the diameter expansion scheduled portion 2 is expanded radially outwardly while preventing the other portion from being expanded, or that the diameter expansion scheduled portion 2 is radially expanded while controlling the expansion amount of the other portion.

In the upsetting manufactured product 6A, the diameter expanded portion 3 corresponds to one piston portion of a double-headed piston, and the part of the raw material 1 to which diameter expansion processing is not performed corresponds to a shank 4 of a double-headed piston.

Figure 2A:
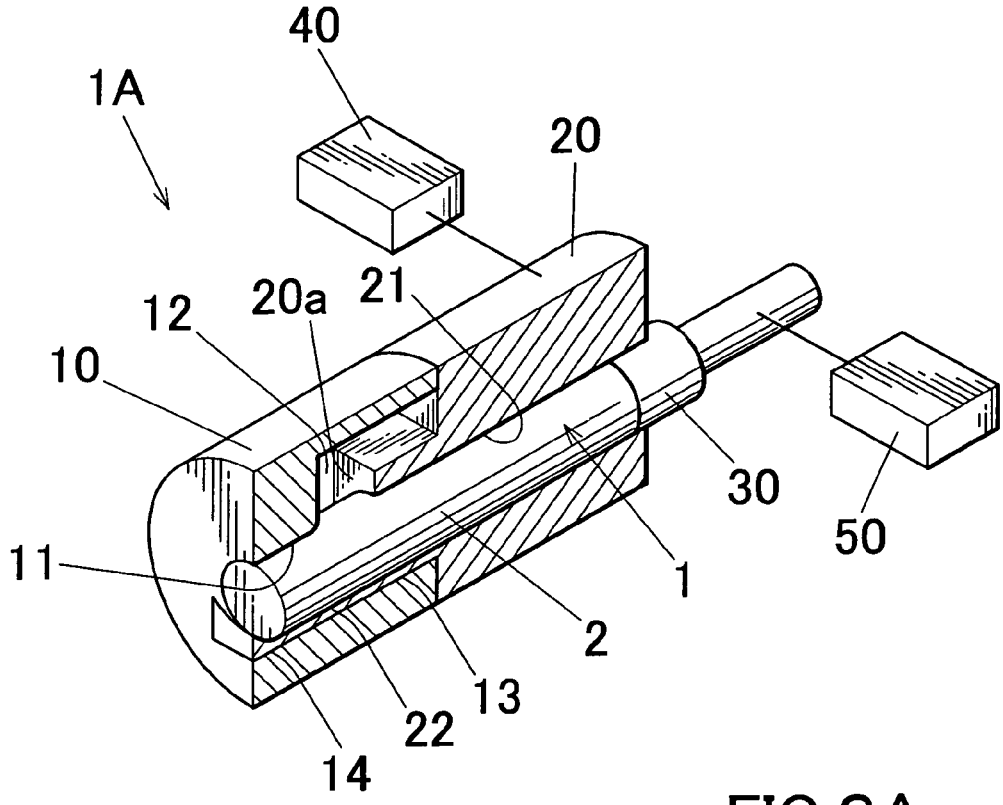
FIG. 2A is a cross-sectional perspective view of the upsetting apparatus showing the state before expanding the diameter expansion scheduled portion of the raw material by the upsetting apparatus.
Figure 2B:
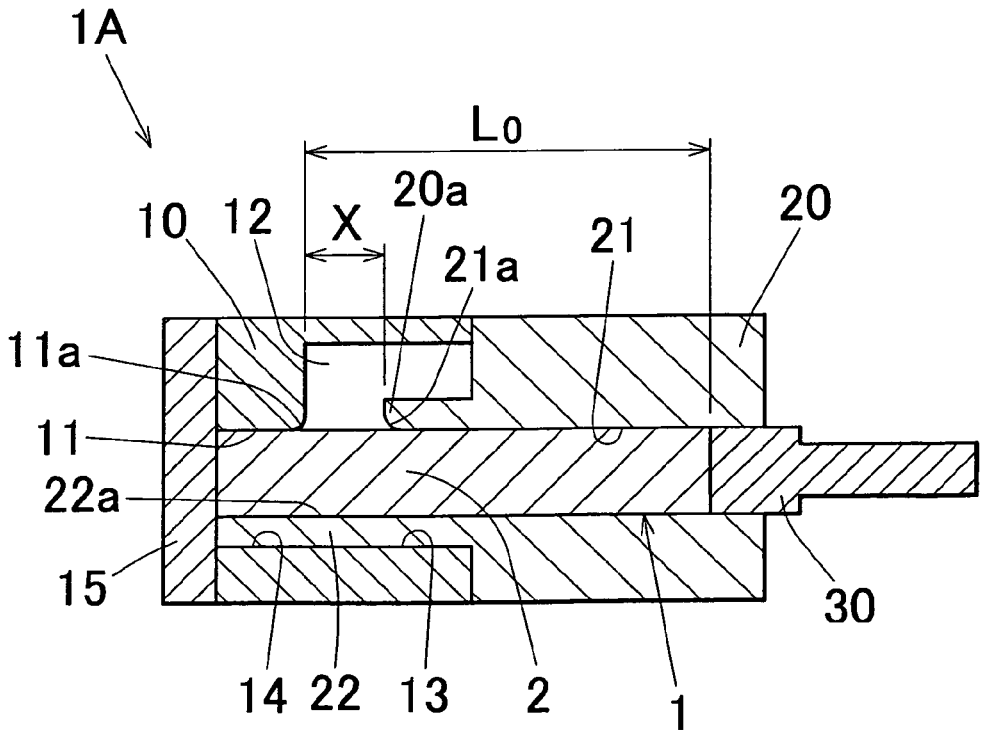
FIG. 2B is a cross-sectional view of the upsetting apparatus in the state shown in FIG. 2A.

The upsetting apparatus 1A is used to expand the diameter of the diameter expansion scheduled portion 2 of the raw material 1 as shown in FIGS. 1 to 2B. This upsetting apparatus 1A is equipped with a fixed die 10, a guide 20, a punch 30, a guide driving apparatus 40, and a punch driving apparatus 50.

The fixed die 10 is a member for fixing the raw material 1 so as not to move in the axial direction thereof at the time of the upsetting. At one axial end portion of the fixed die 10, a raw material fixing insertion hole 11 in which the non-diameter-expansion scheduled portion of the raw material 1 is to be inserted and secured is formed so as to extend in the axial direction of the fixed die 10. In this embodiment, the end portion of the raw material 1 opposite to the diameter expansion scheduled portion 2 corresponds to the non-diameter-expansion scheduled portion. By inserting this end portion in the insertion hole 11, the raw material 1 is secured to the fixed die 10 with the diameter expansion scheduled portion 2 of the raw material 1 protruded from the fixed die 10.

Furthermore, at the other axial end portion of this fixed die 10, a molding dented portion 12 (that is, a molding cavity) for forming the diameter expansion scheduled portion 2 of the raw material 1 into a designed shape (that is, a cylindrical shape) is formed. In order to make the central axis of the diameter expanded portion 3 shift with respect to the central axis of the raw material 1 after the diameter expansion of the diameter expansion scheduled portion 2 of the raw material 1, the opening of the insertion hole 11 is formed at a position shifted with respect to the central portion of the bottom surface of the molding dented portion 12.

Moreover, at the opening edge portion of the insertion hole 11 of the fixed die 10, as shown in FIG. 2B, chamfering is executed along the entire periphery thereof, and therefore the cross-sectional shape of this edge portion is formed into a round shape.

"11*a*" denoted the chamfered portion formed at the edge portion.

The fixed die 10 is comprised of a plurality of vertically divided pieces (two pieces in this embodiment), i.e., a split mold.

"15" denotes a bottom portion of the fixed die 10. This bottom portion 15 is a member for blocking the other opening of the insertion hole 11 so as to prevent the raw material 1 inserted in the insertion hole 11 from coming out of the other opening.

The guide 20 is provided with an insertion hole 21 for holding the diameter expansion scheduled portion 2 of the raw material 1 in a buckling preventing state while allowing the axial sliding thereof. Namely, this guide 20 holds the diameter expansion scheduled portion 2 of the raw material 1 in the insertion hole 21 in a buckling preventing state while allowing the axial sliding thereof in a state in which the diameter expansion scheduled portion 2 of the raw material 1 is inserted in the insertion hole 21. This insertion hole 21 extends in the axial direction of the guide 20 in a penetrated manner. The diameter of this insertion hole 21 is set such that the raw material 1 can be fittedly inserted in the insertion hole 21 in an axial slide allowable manner.

This guide 20 guides the material of the diameter expansion scheduled portion 2 of the raw material 1 inserted and disposed in the insertion hole 21 into the molding dented portion 12.

Furthermore, as shown in FIG. 2B, the opening edge portion of the insertion hole 21 of the tip end portion 20*a* of the guide 20 is chamfered into a round cross-sectional shape. "21*a*" denotes a chamfered portion formed on the edge portion.

Furthermore, as shown in FIG. 1, at one portion of the tip end portion of the guide 20, a diameter expansion preventing protruded portion 22 is integrally protruded in the axial direction of the guide 20, so that this protruded portion 22 is moved together with the guide 20 in accordance with the movement of the guide 20. At the time of the diameter expansion of the diameter expansion scheduled portion 2, a part of the peripheral surface of the diameter expansion scheduled portion 2 of the raw material 1 inserted in the insertion hole 21 of the guide 20 comes into contact with the side surface 22*a* faced to the side of the insertion hole 21 of the protruded portion 22, which restrains the diameter expansion of the contacting portion of the diameter expansion scheduled portion 2 contacting with the protruded portion 22.

On the other hand, at a part of the peripheral surface 12*a* as a molding surface of the molding dented portion 12 of the fixed die 10, a slide groove portion 13 extended in the axial direction of the fixed die 10 in which the protruded portion 22 of the guide 20 is to be slidably inserted in the axial direction of the fixed die 10 is provided. Furthermore, in this fixed die 10, a slide hole portion 14 continued from the slide groove portion 13 is extended in the axial direction of the fixed die 10. In this slide hole portion 14, the protruded portion 22 of the guide 20 inserted in the slide groove portion 13 is inserted slidably.

Furthermore, the side surface 22*a* of the protruded portion 22 of the guide 20 with which a part of the peripheral surface of the diameter expansion scheduled portion 2 of the raw material 1 comes into contact is formed into a surface corresponding to the peripheral surface shape of the diameter expanded portion 3 of the raw material 1. Therefore, this side surface 22*a* of the protruded portion 22 is formed such that the side surface 22*a* is flush with the peripheral surface 12*a* of the molding dented portion 12 in the peripheral direction in a state in which the protruded portion 22 is inserted in the slide groove portion 13. In this embodiment, the side surface 22*a* of the protruded portion 22 is formed into a curved surface circular in cross-section corresponding to the peripheral surface shape of the cylindrical diameter expanded portion 3.

The punch 30 is used to pressurize the diameter expansion scheduled portion 2 of the raw material 1 inserted in the insertion hole 21 of the guide 20 in the axial direction. This punch 30 is placed at one of the axial both ends of the raw material 1 which is the side the diameter expansion scheduled portion 2 of the raw material 1 is located.

The punch driving apparatus 50 is used to move the punch 30 in the axial direction of the raw material 1 to give a driving force for pressurizing the diameter expansion scheduled portion 2 of the raw material 1 to the punch 30. This punch driving apparatus 50 is connected to the punch 30 so as to give a driving force to the punch 30 by a machine cam, fluid pressure (oil pressure, gas pressure), etc., using a pressing machine. In this punch driving apparatus 50, it is possible to make the speed of the punch constant when the target shape (designed shape) is determined, and therefore no apparatus for controlling the speed is required. However, by giving a control apparatus for controlling the pressing speed, it also becomes possible to change arbitrarily the upset shape (the shape of the diameter expanded portion).

Figure 3A:
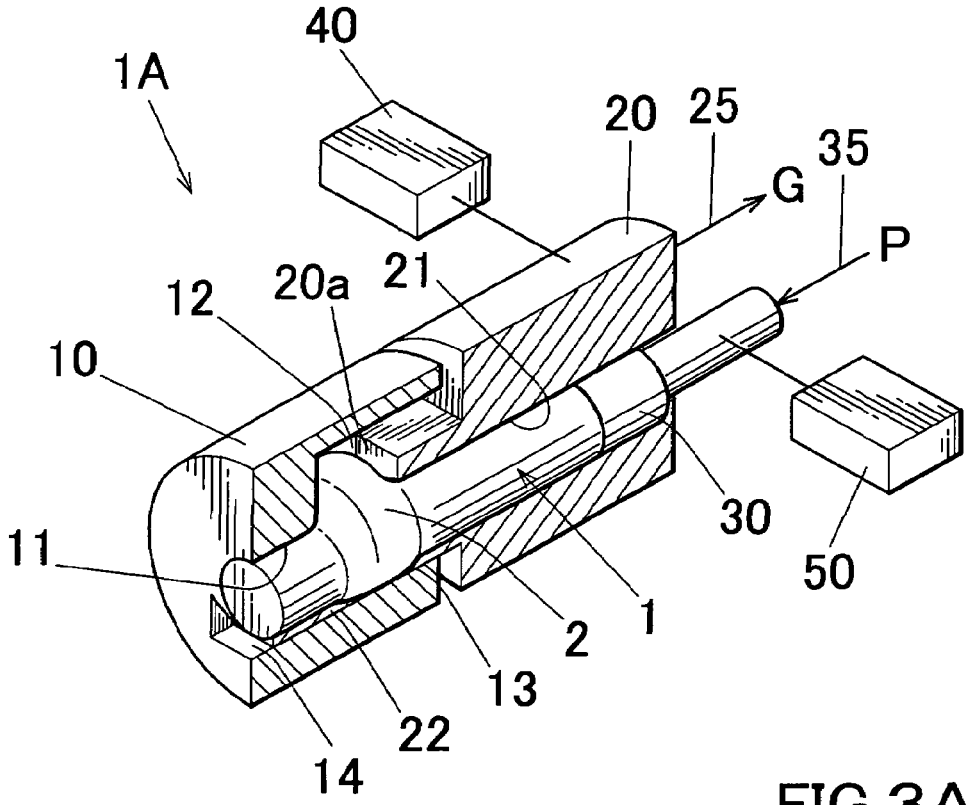
FIG. 3A is a cross-sectional perspective view of the upsetting apparatus showing the state in which the diameter expansion scheduled portion of the raw material is being expanded in diameter by the upsetting apparatus.
Figure 3B:
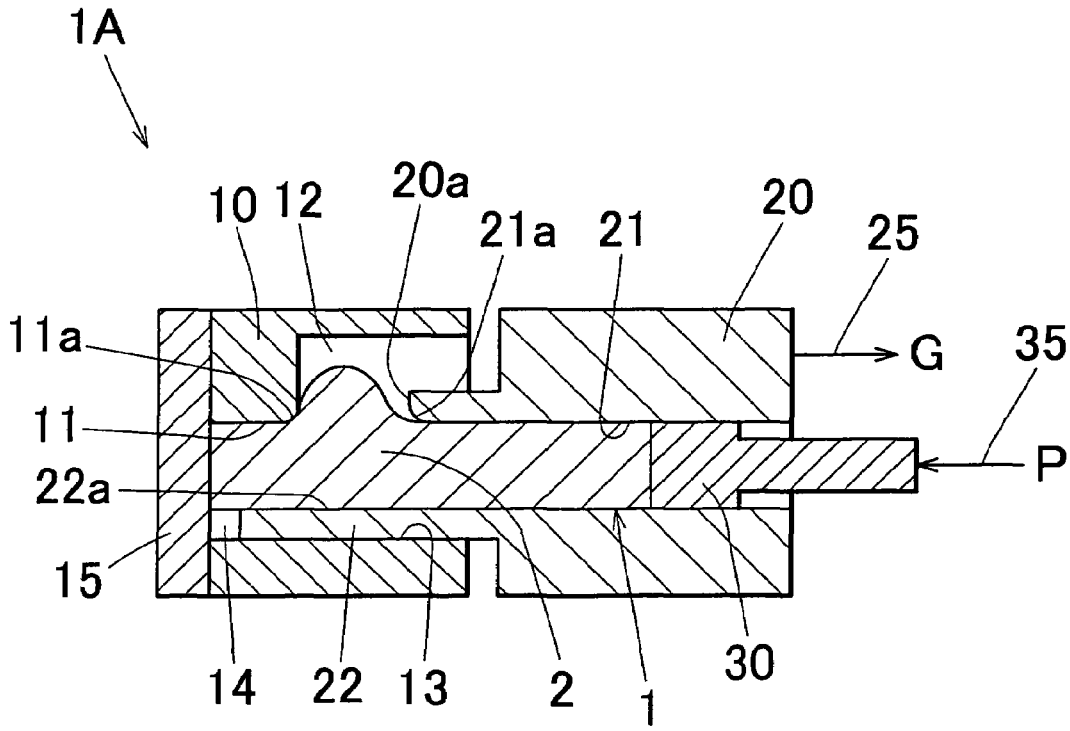
FIG. 3B is a cross-sectional view of the upsetting apparatus in the state shown in FIG. 3A.

The guide driving apparatus 40 is configured to move the guide 20 in a direction opposite to the moving direction 35 of the punch 30 (i.e., the pressure direction to the raw material diameter expansion scheduled portion 2 by the punch 35) (see FIG. 3B). This guide driving apparatus 40 is connected to the guide 20 so as to give a driving force to the guide 20 by fluid pressure (oil pressure, gas pressure), an electric motor, a spring, etc. In this punch driving apparatus 40, it is possible to make the speed of the guide constant when the target shape (designed shape) is determined, and therefore no apparatus for controlling the speed is required. However, by giving a control apparatus for controlling the pressing speed, it also becomes possible to change arbitrarily the upset shape (the shape of the diameter expanded portion).

Figure 4A:
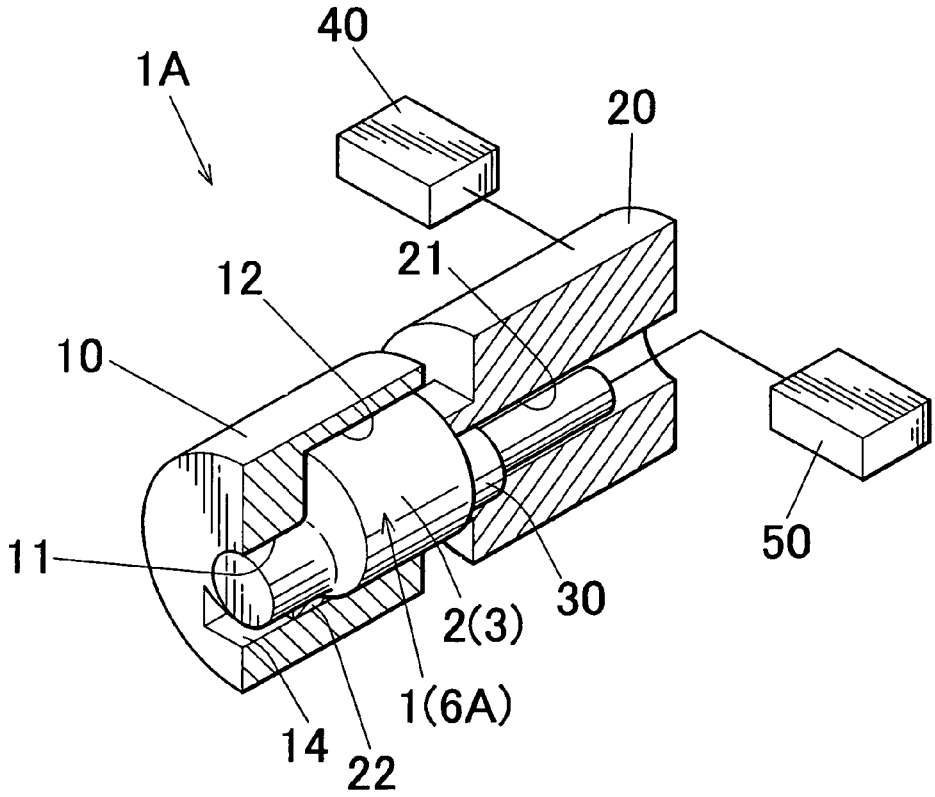
FIG. 4A is a cross-sectional perspective view of the upsetting apparatus showing the state after expanding the diameter expansion scheduled portion of the raw material by the upsetting apparatus.

Next, an upsetting method using the upsetting apparatus 1A according to the first embodiment will be explained as follow. In FIGS. 2A, 3A, and 4A, in order to facilitate the relative positional relation between the fixed die 10 and the guide 20, the bottom portion 15 of the fixed die 10 is not illustrated, respectively.

First, as shown in FIG. 2A and FIG. 2B, the non-diameter-expansion scheduled portion of the raw material 1 which is an end portion of the raw material 1 opposite to the diameter expansion scheduled portion 2 is inserted in the insertion hole 11 of the fixed die 10 to thereby fix the raw material 1 to the fixed die 10 so as not to move in the axial direction thereof. Thus, the diameter expansion scheduled portion 2 of the raw material 1 is disposed in the molding dented portion 12 of the fixed die 10. In this fixed state, the diameter expansion scheduled portion 2 of the raw material 1 is protruded from the fixed die 10.

Furthermore, the diameter expansion scheduled portion 2 of the raw material 1 is inserted into the insertion hole 21 of the guide 20 to thereby hold the diameter expansion scheduled portion 2 of the raw material 1 in the insertion hole 21 in a buckling preventing state while allowing the axial sliding of the diameter expansion scheduled portion 2. Furthermore, the protruded portion 22 of the guide 20 is inserted into the slide groove portion 13 and then into the slide hole portion 14 in the axial direction of the fixed die 10. In this state, a part of the peripheral surface of the diameter expansion scheduled portion 2 of the raw material 1 is in contact with the side surface 22*a* of the protruded portion 22 of the guide 20.

Furthermore, an initial clearance X is formed between the tip end portion 20*a* of the guide 20 and the fixed die 10 (more specifically, the bottom surface of the molding dented portion 12 of the fixed die 10) (see FIG. 2B). In the state before initiating the movement of the punch 30 (i.e., pressurization to the raw material diameter expansion scheduled portion 2 with the punch 30), the distance of this initial clearance X is set to be not larger than the buckling limit length $X_0$ at the cross-sectional area of the exposed portion of the diameter expansion scheduled portion 2 of the raw material 1 exposed between the tip end portion 20*a* of the guide 20 and the fixed die 10. In the present invention, the buckling limit length denotes the buckling limit length in the punch pressurizing force.

Subsequently, as shown in FIGS. 3A and 3B, while pressurizing the diameter expansion scheduled portion 2 of the raw material 1 with the punch 30 in the axial direction by moving the punch 30 by operating the punch driving apparatus 50, the guide 20 is moved in a direction 25 opposite to the moving direction 35 of the punch 30 by operating the guide driving apparatus 40. With this, in a state in which a part of the peripheral surface of the diameter expansion scheduled portion 2 of the raw material 1 exposed in between the tip end portion 20*a* of the guide 20 and the fixed die 10 (more specifically, the bottom surface of the molding dented portion 12 of the fixed die 10) comes into contact with the side surface 22*a* of the protruded portion 22 of the guide 20 and therefore the contacting portion of the diameter expansion scheduled portion 2 of the raw material 1 in contact with the protruded portion 22 is restrained in diameter expansion, the diameter expansion scheduled portion 2 of the raw material 1 (more specifically, a portion of the diameter expansion scheduled portion 2 other than the contacting portion in contact with the protruded portion 22) is expanded in diameter within the molding dented portion 12.

Here, a time lag $t_0$ is set between the moving initiation of the punch 30 and the moving initiation of the guide 20. That is, in initiating the pressurization of the diameter expansion scheduled portion 2 of the raw material 1 with the punch 30, the position of the guide 20 is initially fixed to an initial position, and then the punch 30 is moved to pressurize the diameter expansion scheduled portion 2 of the raw material 1 with the punch 30 in the axial direction. After passing the lag $t_0$, the guide 20 is moved in a direction 25 opposite to the moving direction 35 of the punch 30 while continuously pressurizing the diameter expansion scheduled portion 2 with the punch 30. At this time, the traveling speed of the guide 20 is controlled by a control apparatus of the guide driving apparatus 40 so that the clearance is not larger than the buckling limit length at the cross-sectional area of the exposed portion of the diameter expansion scheduled portion 2 of the raw material 1 exposed between the tip end portion 20*a* of the guide 20 and the fixed die 10. In cases where processing conditions are determined, it is possible to use a cylinder or a machine cam by which a constant speed of a design amount can be obtained.

In addition, in the present invention, the traveling speed of the punch 30 can be constant or variable. Furthermore, in the same manner, the traveling speed of the guide 20 can be constant or variable.

In accordance with the movement of the punch 30 and the guide 20, as shown in FIGS. 3A and 3B, in a state in which the diameter expansion of the contacting portion of the diameter expansion scheduled portion 2 of the raw material 1 in contact with the guide protruded portion 22 is restrained, the diameter expansion scheduled portion 2 of the raw material 1 is gradually expanded in diameter within the molding dented portion 12 and the material of the diameter expansion scheduled portion 2 is filled in the molding dented portion 12.

Figure 4B:
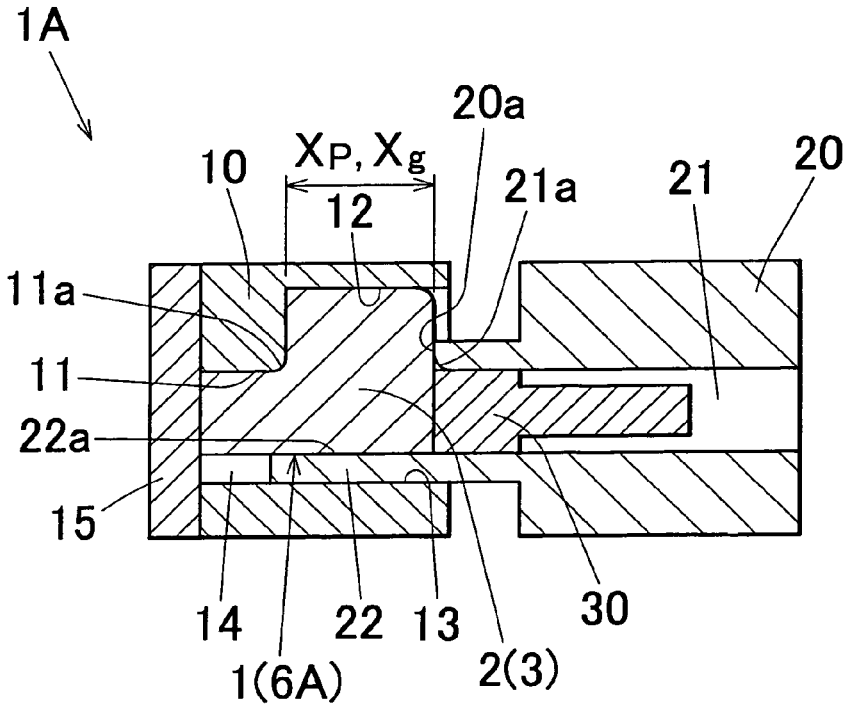
FIG. 4B is a cross-sectional view of the upsetting apparatus in the state shown in FIG. 4A.

As shown in FIGS. 4A and 4B, when the tip end portion of the punch 30 reaches the stop position $X_p$ of the tip end portion of the punch 30 with respect to the fixed die 10 obtained from the design volume of the diameter expanded portion 3, the movement of the punch 30 is stopped. Furthermore, when the tip end portion 20*a* of the guide 20 reaches the stop position $X_g$ of the tip end portion 20*a* of the guide 20 with respect to the fixed die 10 defined by the design, the movement of the guide 20 is stopped. At this time, the material of the diameter expansion scheduled portion 2 of the raw material 1 is fully filled in the molding dented portion 12, and the diameter expansion scheduled portion 2 is formed into the designed shape (i.e., cylindrical shape) expanded in diameter.

With the aforementioned procedures, the upsetting of the diameter expansion scheduled portion 2 of the raw material 1 is completed.

Thereafter, by removing the raw material 1 from the fixed die 10, a desired upsetting manufactured product 6A shown in FIG. 5 can be obtained.

In the first embodiment, the stop position $X_p$ of the tip end portion of a punch 30 with respect to the fixed die 10 and the stop position $X_g$ of the tip end portion 20*a* of the guide 20 with respect to the fixed die 10 coincide with each other. It should be noted that, in the present invention, it is not required that $X_P$ and $X_g$ coincide with each other.

Thus, in the upsetting method of the first embodiment, by moving the guide 20 in an opposite direction 25 opposite to the moving direction 35 of the punch 30 while pressurizing the diameter expansion scheduled portion 2 of the raw material 1 with the punch 30 in an axial direction by moving the punch 30, the diameter expansion scheduled portion 2 of the raw material 1 exposed between the tip end portion 20*a* of the guide 20 and the fixed die 10 is expanded in diameter in a state in which the diameter expansion of the contacting portion in contact with the guide protruded portion 22 of the diameter expansion scheduled portion 2 is restrained. Therefore, the diameter expansion scheduled portion 2 of the raw material 1 can be expanded in diameter unevenly in the peripheral direction. Therefore, an upsetting manufactured product 6A in which the central axis of the diameter expanded portion 3 is shifted from the central axis of the raw material 1 can be obtained easily. Therefore, according to the upsetting method using the upsetting apparatus 1A, as to a preform for manufacturing a part of a double-headed piston, it becomes possible to obtain a preform similar to a final product in shape. Consequently, the number of manufacturing steps can be reduced, which makes it possible to manufacture a part of a double-headed piston with high sufficient yield.

Furthermore, since such upsetting manufactured product 6A can be obtained by the execution of the upsetting using the guide 20 integrally provided with a protruded portion 22 at the tip end portion 20*a*, such upsetting can be performed by the upsetting apparatus 1A simple in structure.

Furthermore, since the side surface 22*a* of the protruded portion 22 of the guide 20 is formed into a surface corresponding to the peripheral surface of the diameter expanded portion 3 of the raw material 1, the designed shape of the diameter expanded portion 3 of the raw material 1 can be assuredly obtained, resulting in a preform more similar to the final product shape.

Furthermore, since chamfering (chamfered surface 21*a*) is executed to the opening edge of the insertion hole 21 located at the tip end portion 20*a* of the guide 20, a back pressure of the material of the raw material 1 is effectively applied to the tip end portion 20*a* of the guide 20 at the time of upsetting. Consequently, the driving force of the guide driving apparatus 40 required to move the guide 20 can be decreased, which makes it possible to miniaturize the guide driving apparatus 40.

Furthermore, since chamfering (chamfered surface 11*a*) is executed to the opening edge of the raw material fixing insertion hole 11 of the fixed die 10, stress concentration, which may occur at the angle portion formed between a portion of the raw material 1 fixed by the fixed die 10 and the diameter expanded portion 3, can be reduced.

Next, preferable processing conditions in the upsetting method of this embodiment will be explained below.

Hereinafter,

"P" denotes an average moving speed of the punch 30 from the moving initiation, "G" denotes an average moving speed of the guide 20 from the moving initiation, "$X_0$" denotes a buckling limit length at the cross-sectional area of the diameter expansion scheduled portion 2 of the raw material 1 before the upsetting, "X" denotes an initial clearance between the tip end portion 20*a* of the guide 20 and the fixed die 10 ($0 \leqq X \leqq X_0$), "$L_0$" denotes a length of the raw material 1 before the execution of the upsetting required for the diameter expanded portion 3, "$X_p$" denotes a stop position of the tip end portion of the punch 30 with respect to the fixed die 10, which can be obtained from the design volume of the diameter expanded portion 3, "$X_g$" denotes a designed stop position of the tip end portion 20*a* of the guide 20 with respect to the fixed die 10, and "$t_0$" denotes a time lag from the moving initiation of the punch 30 to the moving initiation of the guide 20 ($0 \leqq t_0$).

In this upsetting method, it is preferable that "G" satisfies the following equation (i).

$$G=(X_g-X)P/(L_0-X_P-Pt_0) \quad \text{(i)}$$

When "G" satisfies the aforementioned equation (i), the diameter expansion scheduled portion 2 of the raw material 1 can be assuredly expanded in diameter into a designed shape.

The reason for the above equation (i) on G will be explained below.

If the time from the moving initiation of the punch 30 to the completion of the upsetting (i.e., upsetting time) is defined as "t," the distance between the tip end portions of the punch 30 and the fixed die 10 at the time of the completion of the upsetting, i.e., the position $X_P$ of the tip end portion of the punch 30 with respect to the fixed die 10 can be given by the following equation (i-a)

$$L_0-Pt=X_P \quad \text{(i-a)}$$

$$\therefore t=(L_0-X_P)/P \quad \text{(i-b)}$$

Moreover, the distance $X_g$ between the tip end portion 20*a* of the guide 20 and the fixed die 10 at the time of the completion of the upsetting t, i.e., the position $X_g$ of the tip end portion 20*a* of the guide 20 with respect to the fixed die 10, can be given by the following equation (i-c).

$$X+G(t-t_0)=X_g \quad \text{(i-c)}$$

The aforementioned equation (i) can be is derived by substituting the equation (i-b) for the equation (i-c) and arranging about G.

FIGS. 6A to 9 are schematic views for explaining an upsetting method using an upsetting apparatus according to a second embodiment of the present invention.

Figure 6A:
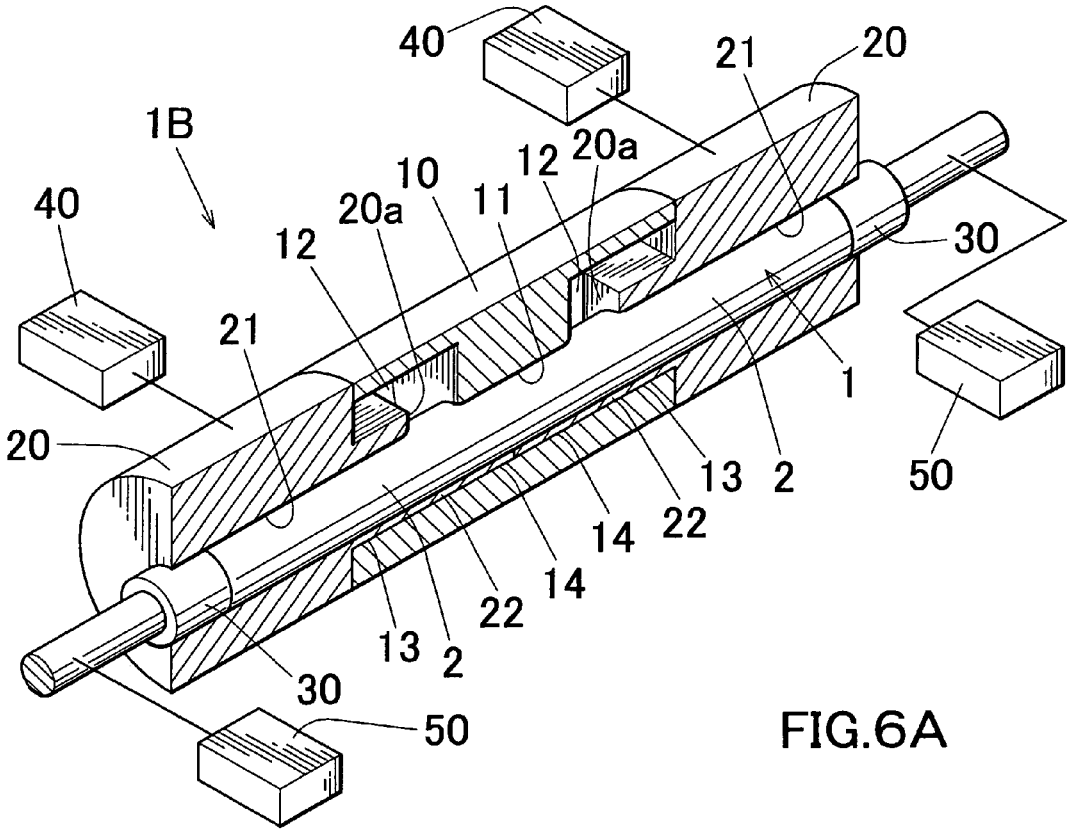
FIG. 6A is a cross-sectional perspective view of an upsetting apparatus showing the state before expanding a diameter expansion scheduled portion of a raw material by an upsetting apparatus according to a second embodiment of the present invention.

In FIG. 6A, "1B" denotes an upsetting apparatus according to a second embodiment, and "1" denotes a raw material. Furthermore, in FIG. 9, "6B" denotes an upsetting manufactured product manufactured by the upsetting apparatus 1B. This upsetting manufactured product 6B is used as a preform for manufacturing a double-headed piston of a compressor, i.e., a preform for a double-headed piston of a compressor. In other words, it can be said that this upsetting apparatus 1B is a manufacturing apparatus for manufacturing a preform for a double-headed piston of a compressor.

Focusing on the differences between this second embodiment and the aforementioned first embodiment, the structure of the upsetting apparatus 1B of this second embodiment will be explained below.

Figure 6B:
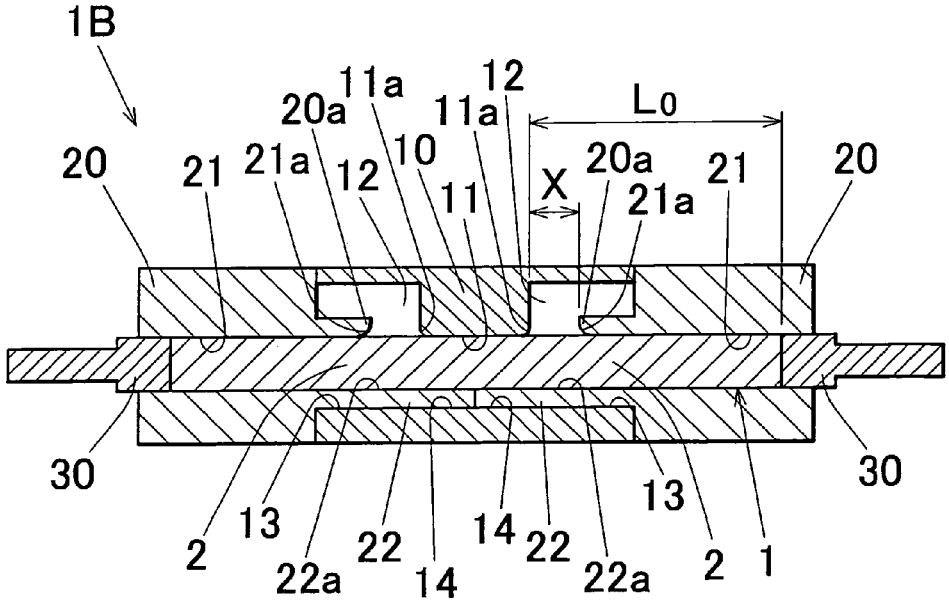
FIG. 6B is a cross-sectional view of the upsetting apparatus in the state shown in FIG. 6A.

As shown in FIGS. 6A and 6B, the raw material 1 is the same straight bar-shaped material as the raw material of the first embodiment and circular in cross-section.

Figure 9:
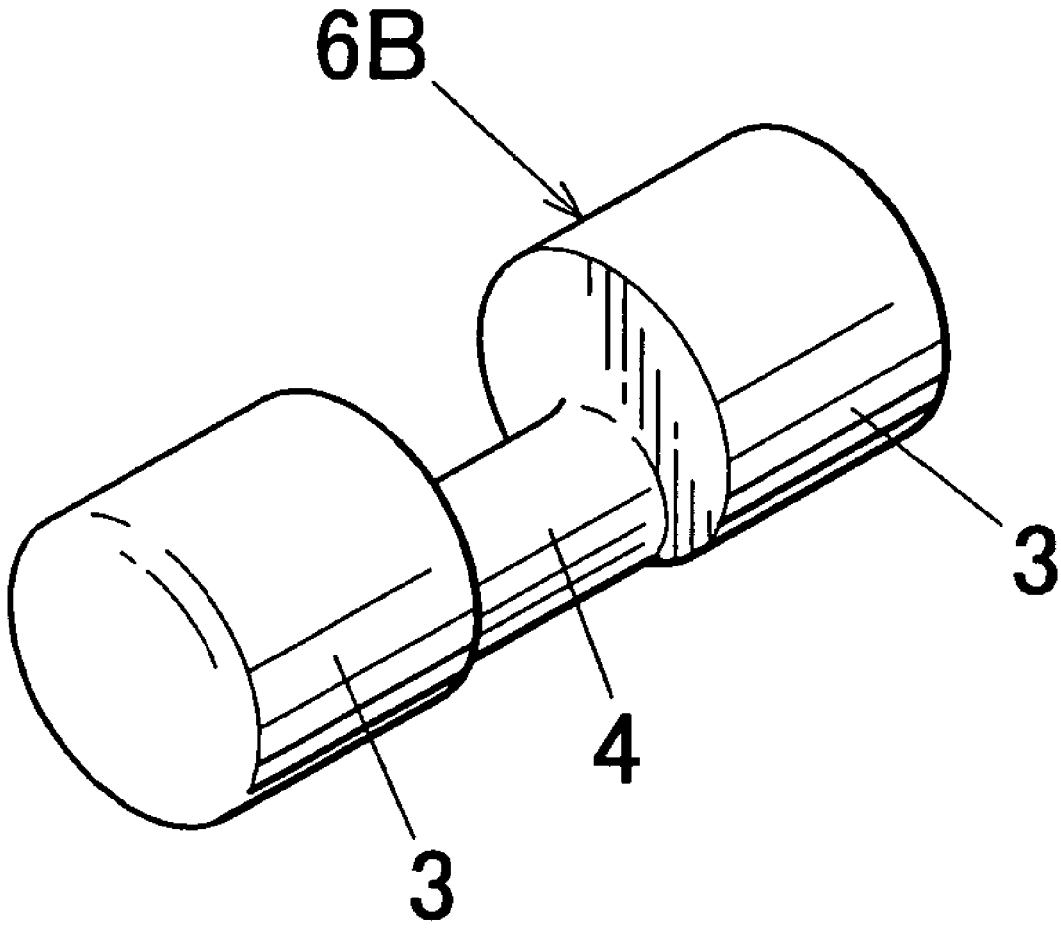
FIG. 9 is a perspective view of the upsetting manufactured product obtained by the upsetting apparatus.

The diameter expansion scheduled portions 2 of this raw material 1 are located at axial both end portions of the raw material 1, more specifically, at the both end portions of the raw material 1. That is, both end portions of the raw material 1 constitute diameter expansion scheduled portions 2 and 2. Each diameter expansion scheduled portion 2 of the raw material 1 is expanded in diameter into a designed shape. Thus, as shown in FIG. 9, a columnar diameter expanded portion 3 is formed at respective end portions of the raw material 1. Each of this diameter expanded portion 3 is shifted in central axis with respect to the raw material 1.

In the upsetting manufactured product 6B, each diameter expanded portion 3 corresponds to a piston portion of a double-headed piston, and the axial intermediate portion of this raw material 1 to which the upsetting is not executed corresponds to a shank 4 of a double-headed piston.

The upsetting apparatus 1B is for executing the upsetting of the respective diameter expansion scheduled portions 2 and 2 which are axial both end portions of the raw material 1, and is equipped with a fixed die 10, two guides 20 and 20, two punches 30 and 30, two guide driving apparatuses 40 and 40, two punch driving apparatus 50 and 50.

The fixed die 10 is provided with a raw material fixing insertion hole 11 for fitting and holding the axial intermediate portion as a non-diameter-expansion scheduled portion of the raw material 1 in such a manner that the insertion hole 11 extends in the axial direction of the fixed die 10 and penetrates the fixed die 10.

Furthermore, at the axial both end portions of this fixed die 10, molding dented portions 12 and 12 each for forming the diameter expansion scheduled portion 2 of the raw material 1 into a designed shape (i.e., columnar shape) are formed. In order to make the central axis of each diameter expanded portion 3 shift with respect to the central axis of the raw material 1 after executing the diameter expansion of each diameter expansion scheduled portion 2 of the raw material 1, the opening of the insertion hole 11 is formed in a position shifted with respect to the central portion of the bottom surface of the molding dented portion 12.

Moreover, chamfering is executed to the opening edge of each insertion hole 11 of the fixed die 10 along the entire periphery thereof, and therefore the edge is formed into a round cross-section. "11*a*" denotes a chamfered portion formed on the edge.

The fixed die 10 consists of vertically divided plural pieces (two pieces in this embodiment), i.e., a split mold.

Each guide 20 has an insertion hole 21 for holding the corresponding diameter expansion scheduled portion 2 of the raw material 1 slidably in the axial direction in a buckling preventing state. This insertion hole 21 extends in the axial direction of the guide 20 and penetrates the guide 20.

Moreover, chamfering is executed to the opening edge portion of the insertion hole 21 of the tip end portion 20*a* of each guide 20, and therefore the edge portion is round in cross-section. "21*a*" is a chamfered portion formed on the edge.

Furthermore, a diameter expansion preventing protruded portion 22 protruded in the axial direction of the guide 20 is integrally formed at one portion of the tip end portion 20*a* of each guide 20.

On the other hand, in one portion of the peripheral surface 12*a* as a molding surface of each molding dented portion 12 of the fixed die 10, in the same manner as in the first embodiment, a slide groove portion 13 for inserting the corresponding protruded portion 22 of the guide 20 extended in the axial direction of the fixed die 10 in an axially slidable manner is formed. Furthermore, the fixed die 10 is provided with a slide hole portion 14 continuing from each slide groove portion 13 and extended in the axial direction of the fixed die 10. In this slide hole portion 14, the protruded portion 22 of the guide 20 inserted in the slide groove portion 13 is inserted in an axially slidable manner. In this embodiment, both the slide hole portions 14 and 14 are connected with each other.

Moreover, the side surface 22*a* of the protruded portion 22 of each guide 20 is formed into a surface corresponding to the peripheral surface of the diameter expanded portion 3 of the raw material 1 in the same manner as in the first embodiment. Therefore, the side surface 22*a* of each protruded portion 22 is formed so as to be flush with the peripheral surface 12*a* of the corresponding molding dented portion 12 along the peripheral direction in a state in which the protruded portion 22 is fitted in the corresponding slide groove portion 13. In this embodiment, the side surface 22*a* of each protruded portion 22 is formed into a curved surface circular in cross-section corresponding to the peripheral surface of the corresponding cylindrical diameter expanded portion 3.

Each punch 30 is for axially pressurizing the corresponding diameter expansion scheduled portion 2 of the raw material 1 inserted in the insertion hole 21 of each guide 20. Both punches 30 and 30 are placed at the axial both ends of the raw material 1.

Each punch driving apparatus 50 is for axially pressurizing the corresponding diameter expansion scheduled portion 2 of the raw material 1 by moving each punch 30 in the axial direction of the raw material 1. Each punch driving apparatus 50 is connected to the corresponding punch 30. The structure of each punch driving apparatus 50 is the same as the first embodiment.

Each guide driving apparatus 40 is for moving each guide 20 in a direction 25 opposite to the moving direction 35 of the punch 30. Each guide driving apparatus 40 is connected to the corresponding guide 20. The structure of each guide driving apparatus 40 is the same as the first embodiment.

Next, an upsetting method using the upsetting apparatus 1B of the second embodiment will be explained below.

First, as shown in FIG. 6A and FIG. 6B, the raw material 1 is fixed to the fixed die 10 so that the raw material 1 would not move unintentionally in the axial direction by fitting the axial intermediate portion of the raw material 1 as a non-diameter-expansion scheduled portion of the raw material 1 in the raw material fixing insertion hole 11 of the fixed die 10. Thus, each diameter expansion scheduled portion 2 of the raw material 1 is placed in the corresponding molding dented portion 12.

Furthermore, each diameter expansion scheduled portion 2 of the raw material 1 is inserted to the corresponding insertion hole 21 of the guide 20 and held therein in a buckling preventing state, and the protruded portion 22 of each guide 20 is inserted in the corresponding slide groove portion 13 and slide hole portion 14. In this state, a part of the peripheral surface of each diameter expansion scheduled portion 2 of the raw material 1 is in contact with the side surface 22*a* of the protruded portion 22 of the corresponding guide 20.

Furthermore, an initial clearance X is set between the tip end portion 20*a* of each guide 20 and the corresponding fixed die 10 (see FIG. 6B). In the same manner as in the first embodiment, in the state before initiating the movement of the punch 30, the distance of this initial clearance X is set to be not larger than the buckling limit length $X_0$ at the cross-sectional area of the exposed portion of the diameter expansion scheduled portion 2 of the raw material 1 exposed between the tip end portion 20*a* of each guide 20 and the corresponding fixed die 10.

Figure 7A:
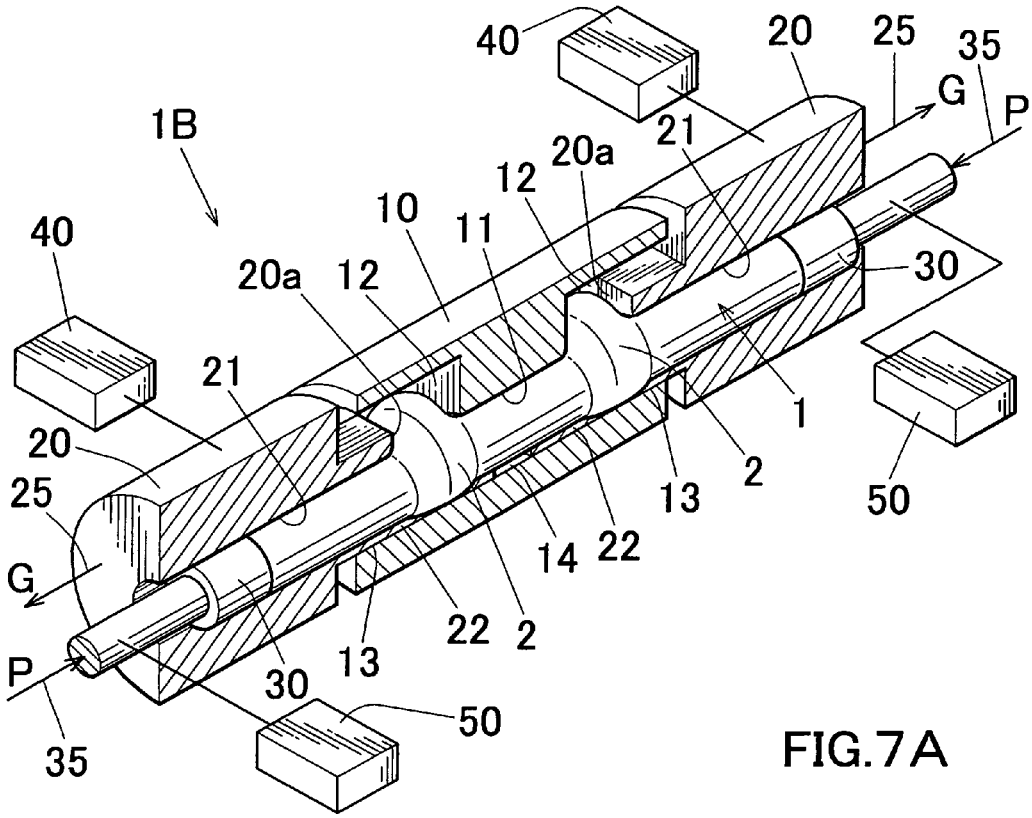
FIG. 7A is a cross-sectional perspective view of the upsetting apparatus showing the state in which the diameter expansion scheduled portion of the raw material is being expanded by the upsetting apparatus.
Figure 7B:
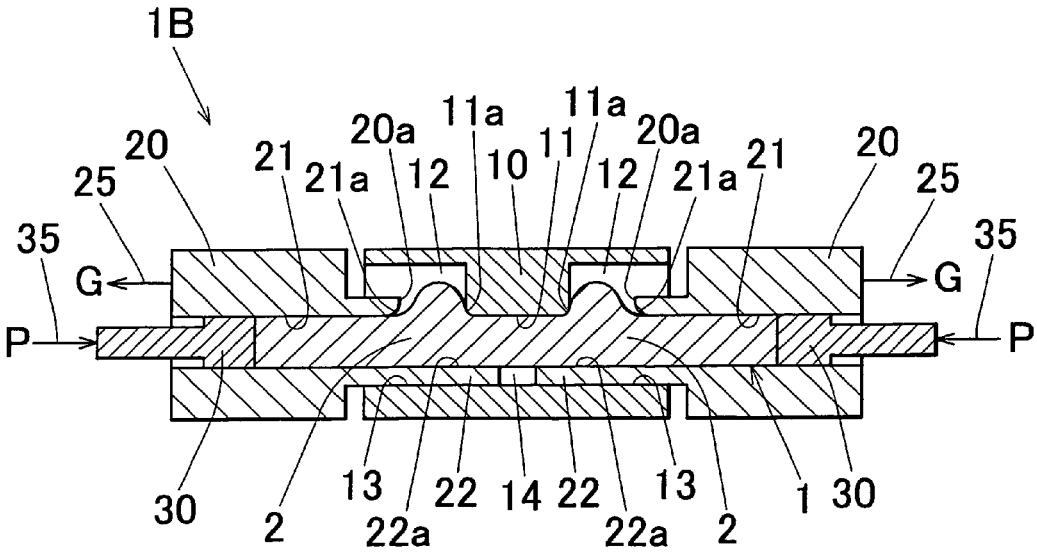
FIG. 7B is a cross-sectional view of the upsetting apparatus in the state shown in FIG. 7A.

Subsequently, as shown in FIG. 7A and FIG. 7B, both the punches 30 and 30 are simultaneously moved by simultaneously operating both punch driving apparatuses 50 and 50. While simultaneously pressurizing each diameter expansion scheduled portion 2 of the raw material 1 by the corresponding punch 30 in the axial direction, each guide 20 is simultaneously moved to a direction 25 opposite to the moving direction 35 of the corresponding punch 30 by simultaneously operating both the guide driving apparatuses 40 and 40. Thus, in a state in which a part of the peripheral surface of the diameter expansion scheduled portion 2 of the raw material 1 exposed between the tip end portion 20*a* of each guide 20 and the fixed die 10 comes into contact with the side surface 22*a* of the protruded portion 22 of the corresponding guide 20 and therefore the diameter expansion of the contacting portion of the diameter expansion scheduled portion 2 of the raw material 1 in contact with the protruded portion 22 is restrained, each diameter expansion scheduled portion 2 of the raw material 1 is simultaneously expanded in diameter within the corresponding molding dented portion 12.

Here, a time lag to is set between the moving initiation of each punch 30 and the moving initiation of each guide 20. That is, in the case of initiating the pressurization of the diameter expansion scheduled portion 2 of the raw material 1 by each punch 30, the position of each guide 20 is fixed and then each punch 30 is moved to thereby simultaneously pressurize each diameter expansion scheduled portion 2 of the raw material 1 with the punch 30 in the axial direction. After passing the time lag to, while continuously pressurizing the diameter expansion scheduled portion 2 of the raw material 1 by each punch 30, each guide 20 is moved to a direction 25 opposite to the moving direction 35 of the corresponding punch 30. The traveling speed of each guide 20 is controlled by a control apparatus of the guide driving apparatus 40 so that the clearance is not larger than the buckling limit length at the cross-sectional area of the exposed portion of the diameter expansion scheduled portion 2 of the raw material 1 exposed between the tip end portion 20*a* of each guide 20 and the fixed die 10. In cases where processing conditions are determined, it is possible to use a cylinder or a machine cam by which a constant speed of a design amount can be obtained.

In accordance with the movement of the punch 30 and the guide 20, as shown in FIGS. 7A and 7B, in a state in which the diameter expansion of the contacting portion of the diameter expansion scheduled portion 2 of the raw material 1 in contact with the guide protruded portion 22 is restrained, the diameter expansion scheduled portion 2 of the raw material 1 (in detail, the portion other than the contact portion of each expanded diameter scheduled portion 2 of the raw material 1 in contact with the guide protruded portion 22) is gradually expanded in diameter within the molding dented portion 12 and the material of the diameter expansion scheduled portion 2 is filled in the molding dented portion 12.

Figure 8A:
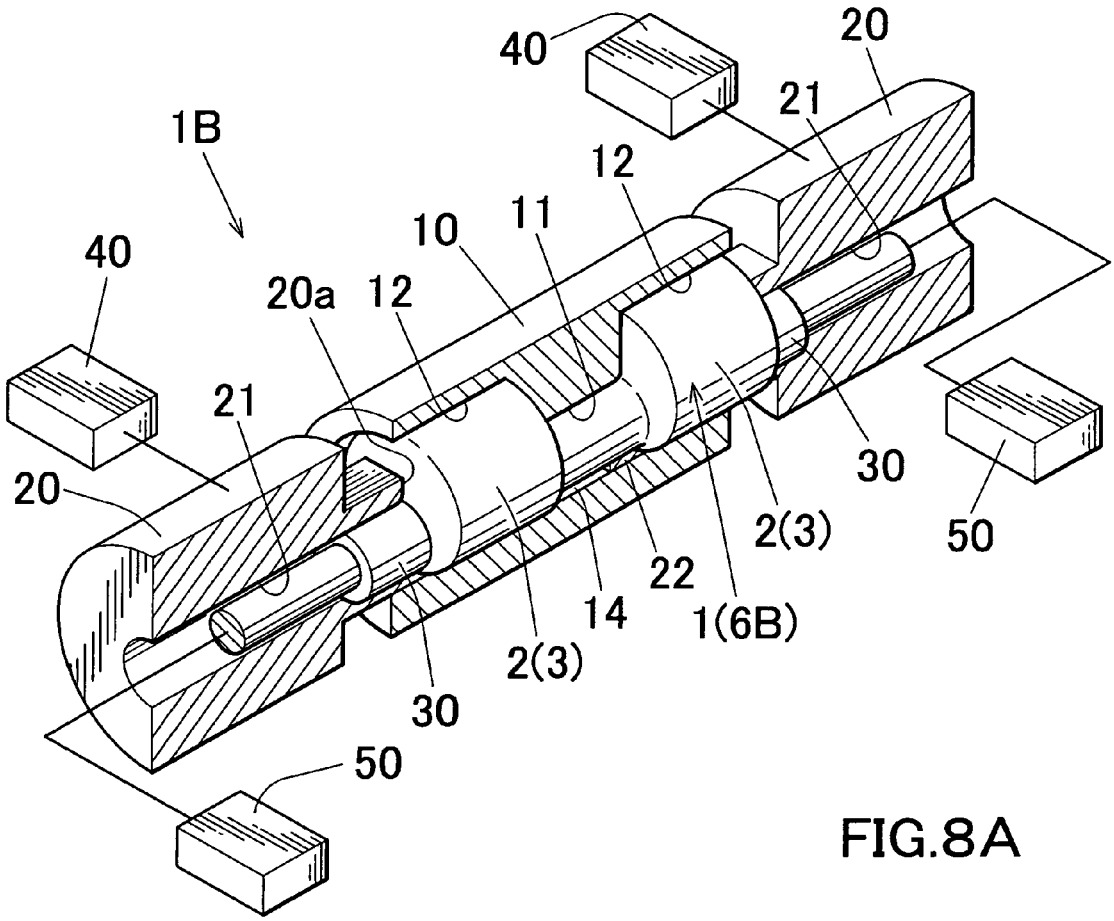
FIG. 8A is a cross-sectional perspective view of the upsetting apparatus showing the state after the expansion of the diameter expansion scheduled portion of the raw material the upsetting apparatus.
Figure 8B:
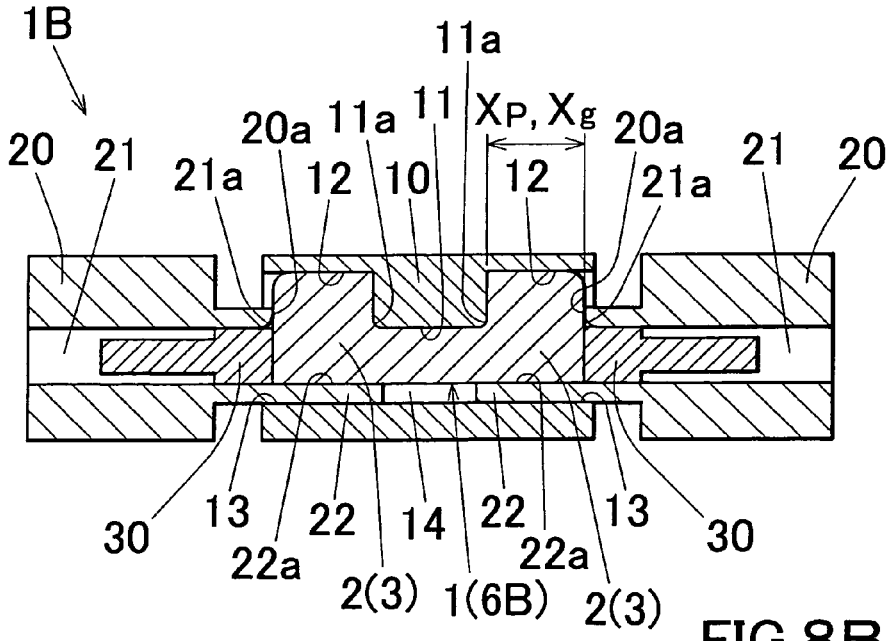
FIG. 8B is a cross-sectional view of the upsetting apparatus in the state shown in FIG. 8A.

As shown in FIG. 8A and FIG. 8B, when the tip end portion of each punch 30 has reached the stop position $X_p$ of the tip end portion of the punch 30 with respect to the fixed die 10 obtained from the design volume of the corresponding diameter expanded portion 3, the movement of the punch 30 is stopped. When the tip end portion 20*a* of each guide 20 has reached the stop position $X_g$ of the tip end portion 20*a* of the guide 20 defined by the design, the movement of each guide 20 is stopped. At this time, the material of each diameter expansion scheduled portion 2 of the raw material 1 is completely filled in the corresponding molding dented portion 12, and each diameter expansion scheduled portion 2 is expanded in diameter into a designed shape (i.e., columnar shape).

With the aforementioned procedures, the upsetting of both the diameter expansion scheduled portions 2 and 2 of the raw material 1 can be completed.

Subsequently, by removing the raw material 1 from the fixed die 10, the desired upsetting manufactured product 6B shown in FIG. 9 can be obtained.

In this second embodiment, the stop position $X_P$ of the tip end portion of each punch 30 with respect to the fixed die 10 and the stop position $X_g$ of the tip end portion 20*a* of the guide 20 with respect to the fixed die 10 coincide with each other. In the present invention, it is not required that $X_P$ and $X_g$ coincide with each other.

It is preferable that the average moving speed G from the moving initiation of each guide 20 meets the aforementioned equation (i).

In the upsetting method of the aforementioned second embodiment, by moving each guide 20 in the direction 25 opposite to the moving direction 35 of the corresponding punch 30 while simultaneously pressurizing each diameter expansion scheduled portion 2 of the raw material 1 by the corresponding punch 30 in the axial direction, both the diameter expansion scheduled portions 2 and 2 of the raw material 1 can be simultaneously expanded in diameter. Therefore, a preform for a double-headed piston (upsetting manufactured product 6B) in which a diameter expanded portion 3 is formed each axial end portion can be manufactured efficiently.

In the second embodiment, the protruded portion 22 is formed at the prescribed portion of each of the two guides 20 and 20. However, in the present invention, the protruded portion 22 can be formed at the prescribed portion of either one of the two guides 20 and 20.

FIGS. 10 to 14 are schematic views for explaining an upsetting method using an upsetting apparatus according to a third embodiment of the present invention.

Figure 10:
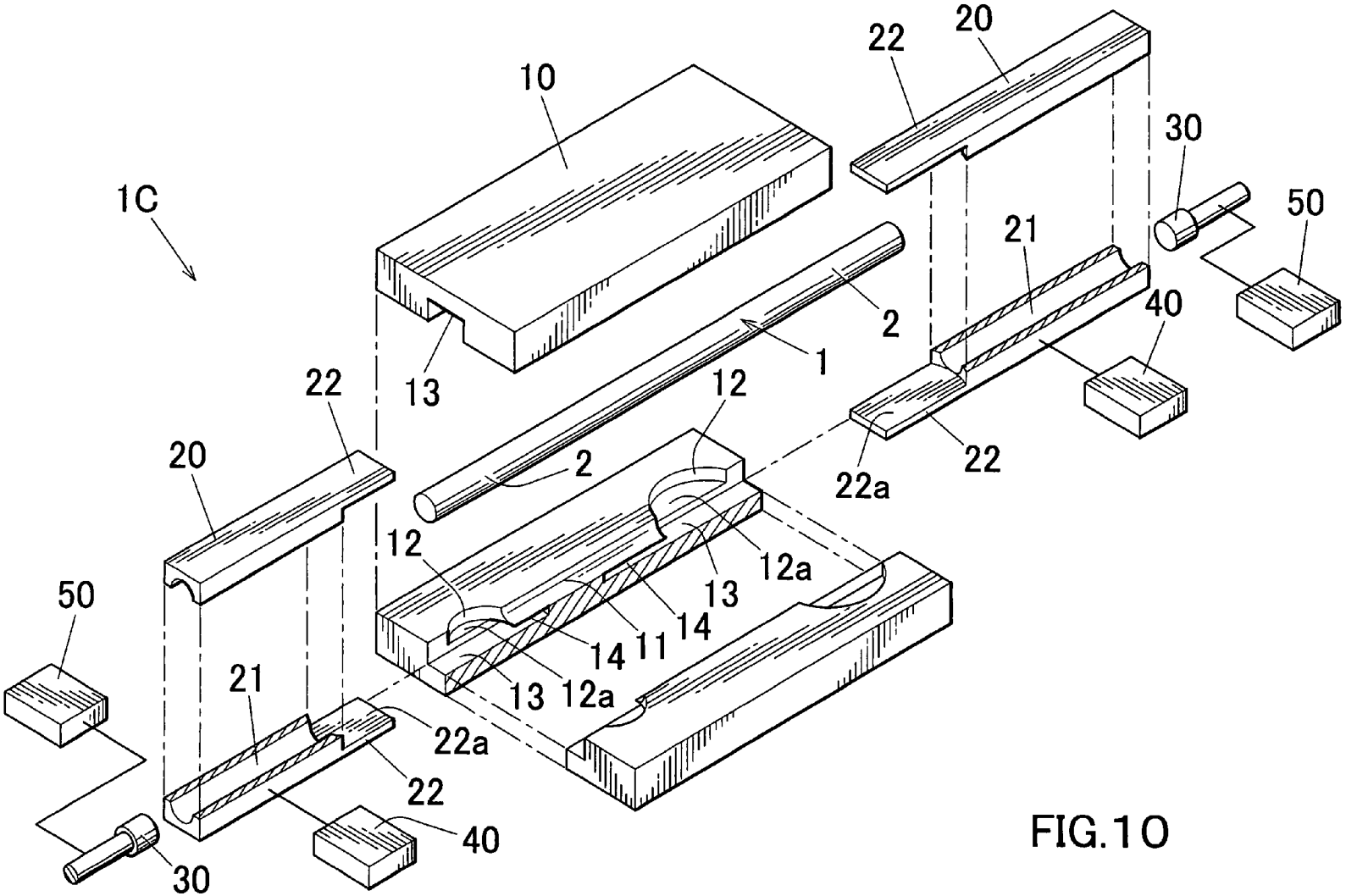
FIG. 10 is a schematic exploded perspective view of a principal part of an upsetting apparatus according to a third embodiment of the present invention.
Figure 11A:
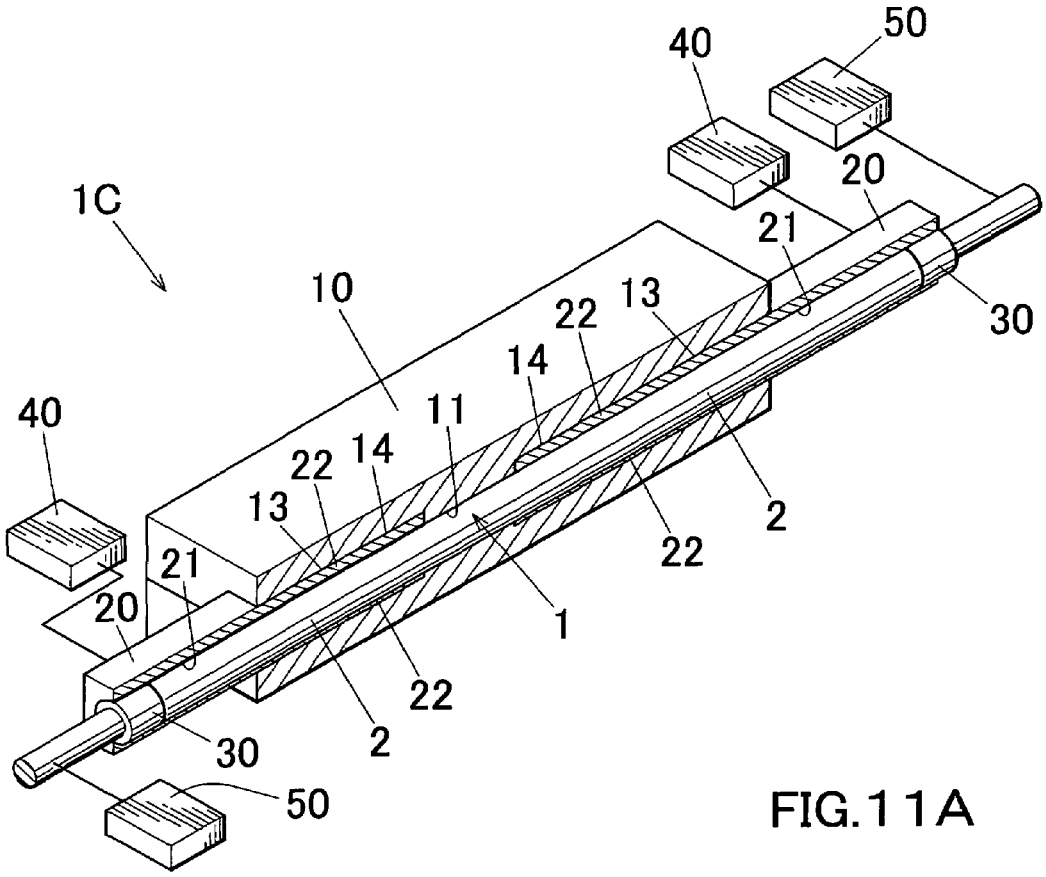
FIG. 11A is a cross-sectional perspective view of the upsetting apparatus showing the state before expanding the diameter expansion scheduled portion of the raw material by the upsetting apparatus.
Figure 11B:
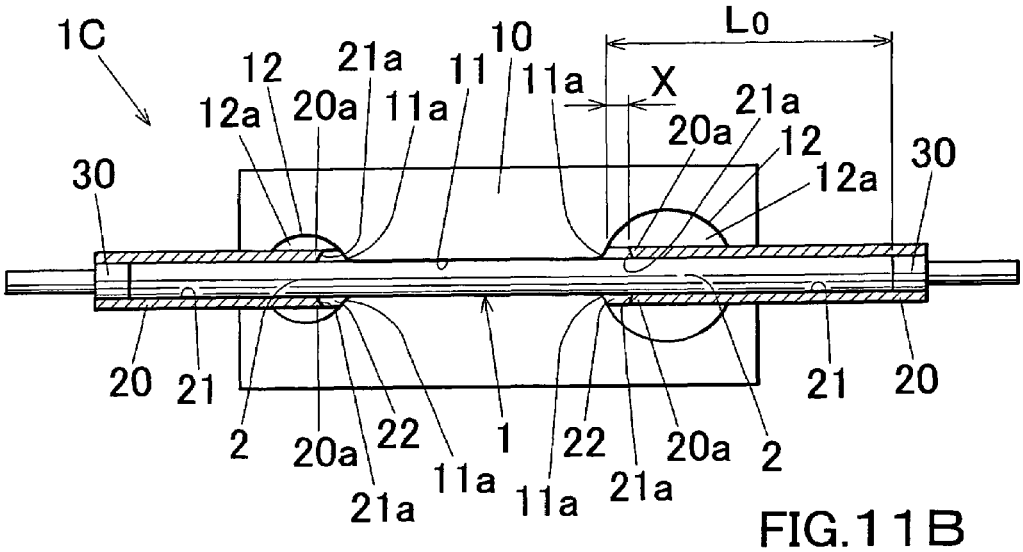
FIG. 11B is a cross-sectional view of the upsetting apparatus in the state shown in FIG. 11A.
Figure 12A:
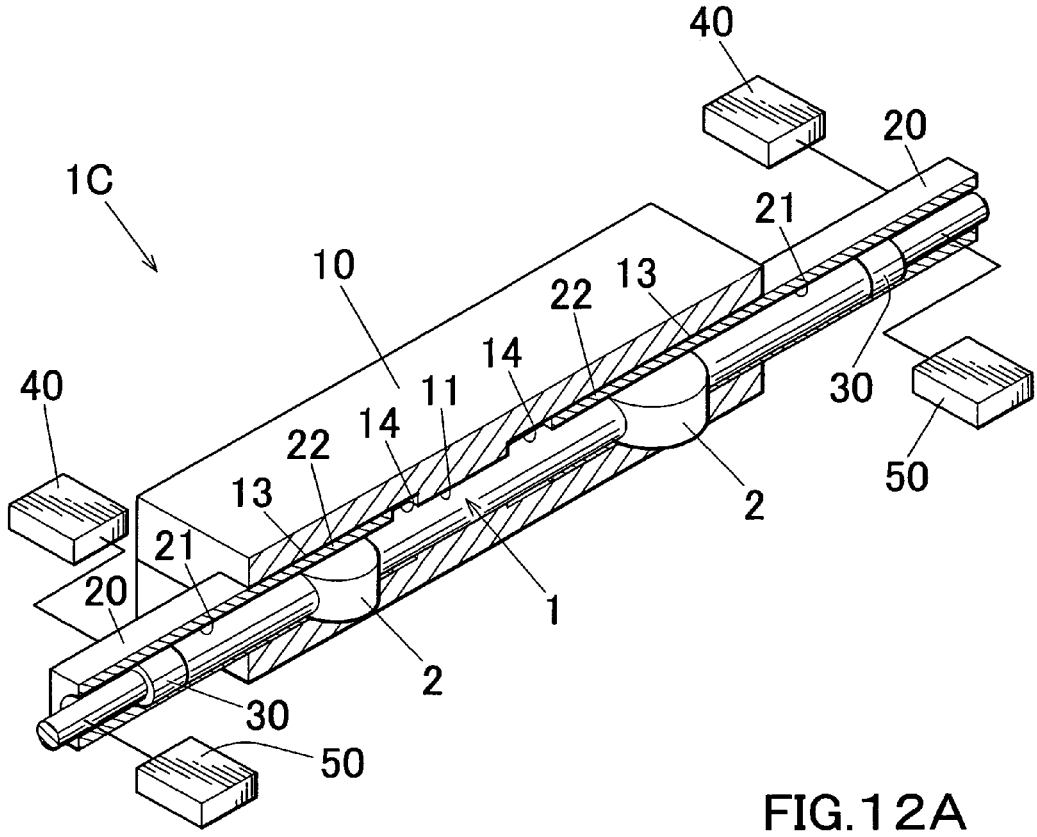
FIG. 12A is across-sectional perspective view of the upsetting apparatus showing the state in which the diameter expansion scheduled portion of the raw material is being expanded in diameter by the upsetting apparatus.
Figure 12B:
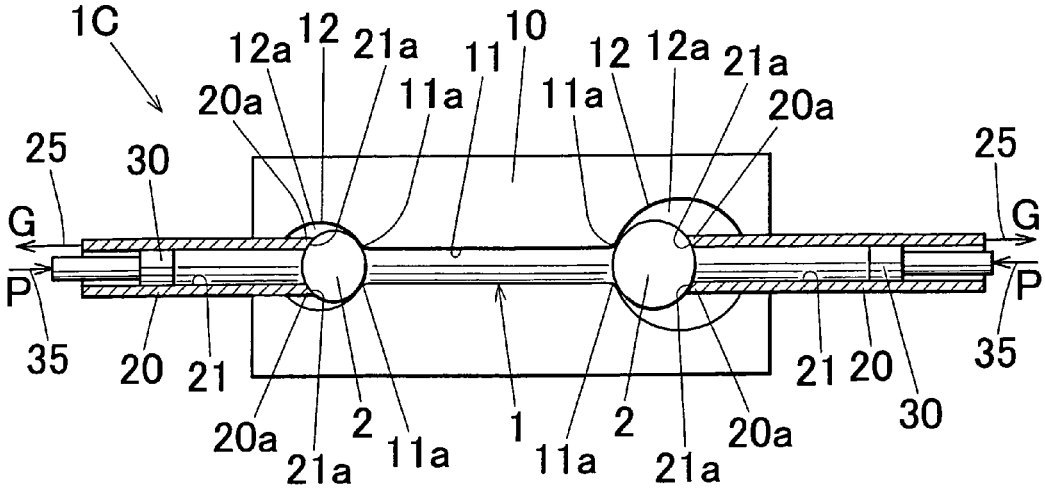
FIG. 12B is a plan view showing the upsetting apparatus in the state shown in FIG. 12A.
Figure 13A:
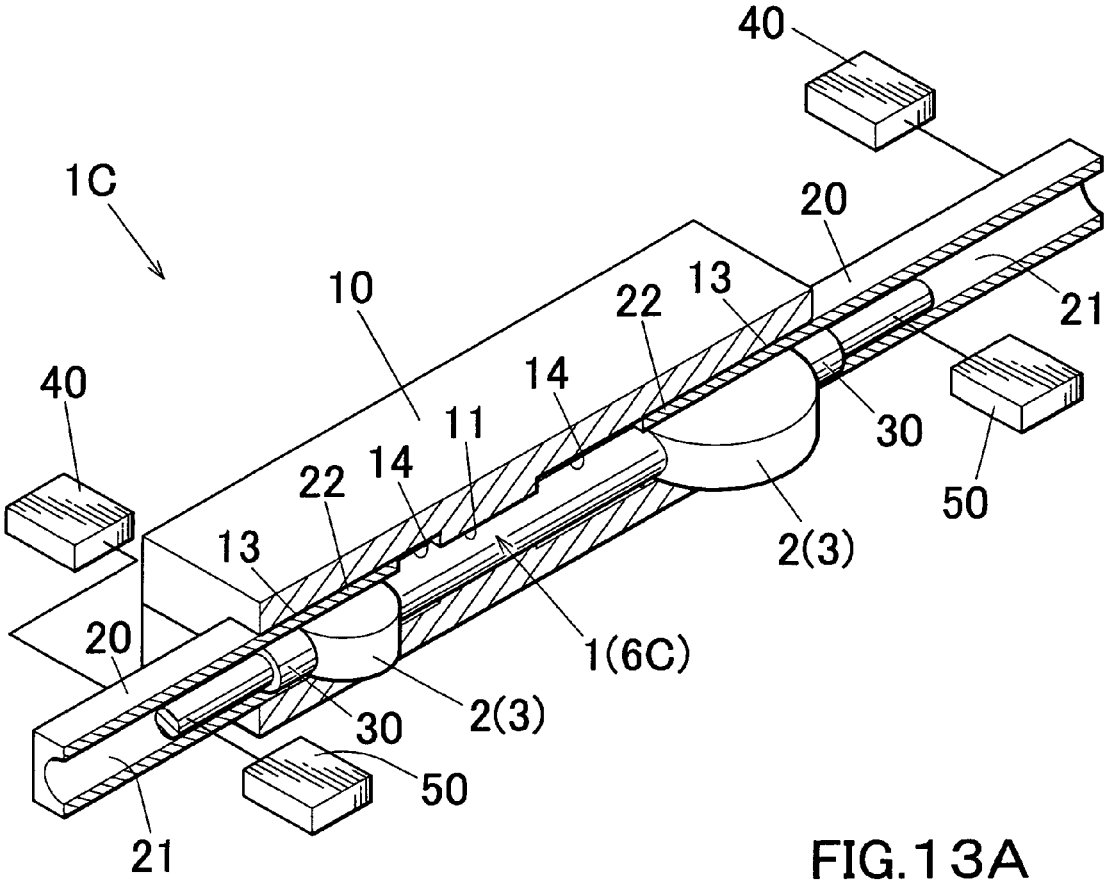
FIG. 13A is a cross-sectional perspective view of the upsetting apparatus showing the state after expanding the diameter expansion scheduled portion of the raw material by the upsetting apparatus.
Figure 13B:
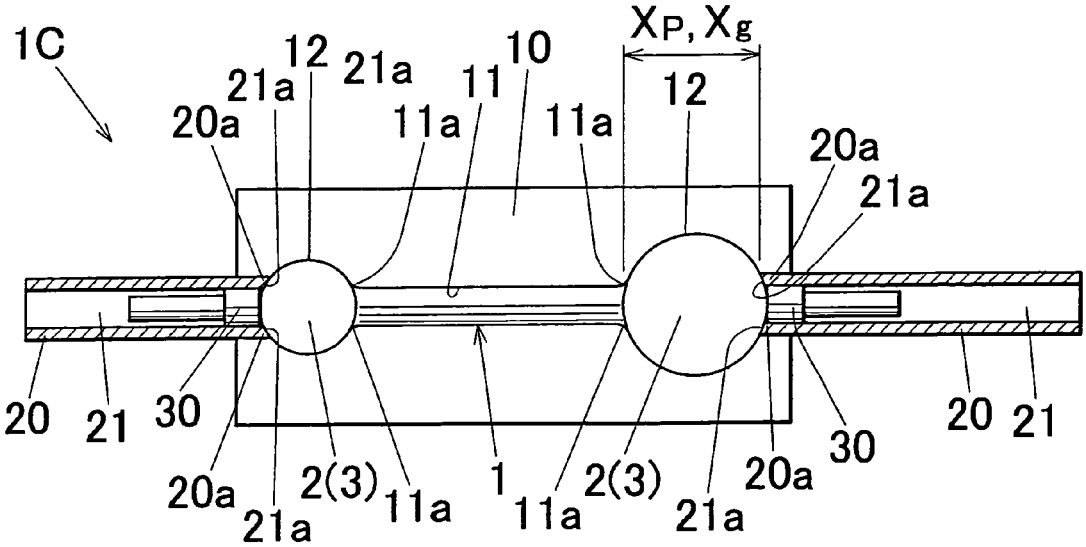
FIG. 13B is a plan view of the upsetting apparatus in the state shown in FIG. 13A.

In FIG. 10, "1C" denotes an upsetting apparatus according to the third embodiment, and, "1" denotes a raw material. Moreover, in FIG. 14, "6C" denotes an upsetting manufactured product manufactured by the upsetting apparatus 1C. This upsetting manufactured product 6C is used as a preform for manufacturing an arm of an automobile, i.e., a preform for an automobile arm. In other words, this upsetting apparatus 1C can be said as an apparatus for manufacturing a preform for an arm of an automobile.

The structure of the upsetting apparatus 1C of the third embodiment will be explained below by focusing on the differences between this embodiment and the first and second embodiments 1A and 1B.

As shown in FIG. 10, the raw material 1 is the same straight bar-shaped material as the raw material of the first embodiment and circular in cross-section.

Figure 14:
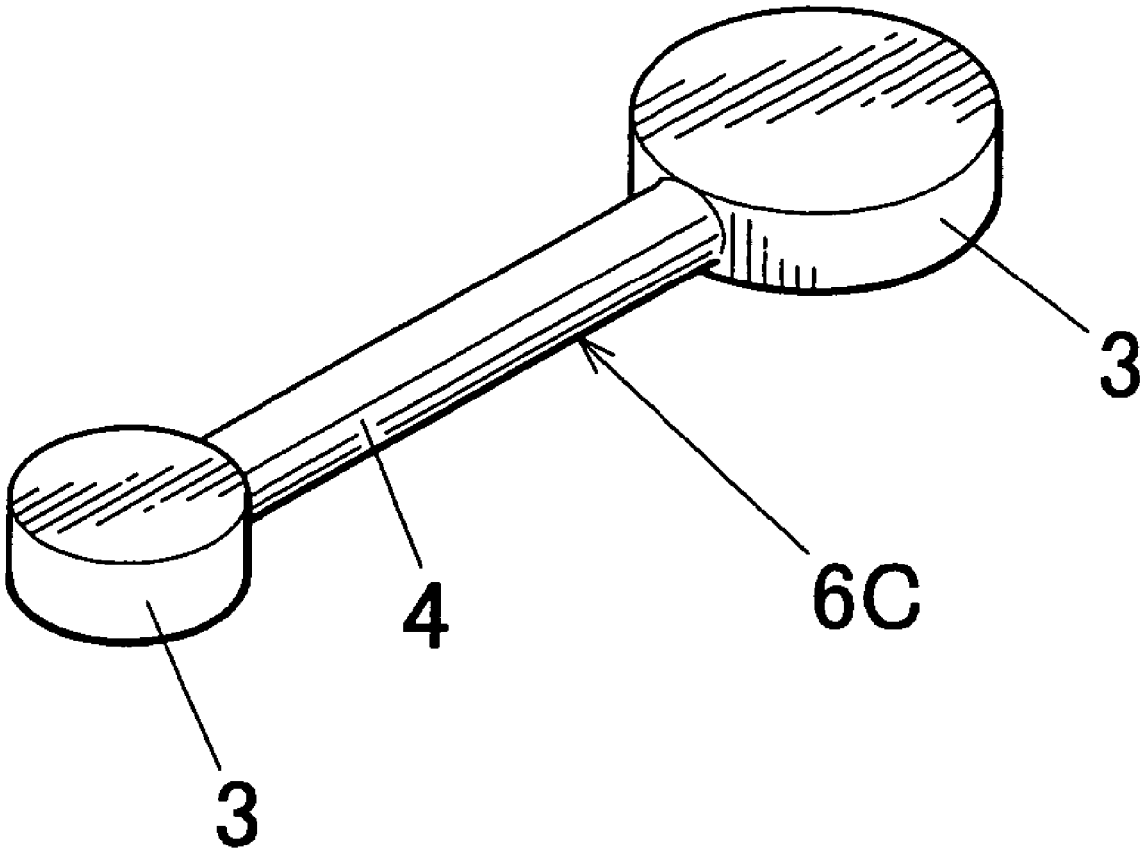
FIG. 14 is a perspective view showing an upsetting manufactured product obtained by the upsetting apparatus.

The diameter expansion scheduled portions 2 of this raw material 1 are located at both axial side portions of the raw material 1, more specifically, both end portions of the raw material 1. That is, both end portions of the raw material 1 are diameter expansion scheduled portions 2 and 2. Each of the diameter expansion scheduled portions 2 and 2 of the raw material 1 is expanded in diameter into a designed shape, whereby circular disc-like diameter expanded portions 3 and 3 will be formed at both ends of the raw material 1 as shown in FIG. 14. Each diameter expanded portion 3 is circularly expanded only in both widthwise directions of the raw material 1 and not expanded in the thickness direction.

In the upsetting manufactured product 6C, each diameter expanded portion 3 corresponds to a connecting portion for an automobile arm (for example, a bush mounting portion) to be connected to another component, and the axial intermediate portion of the raw material 1, which is a part of the raw material 1 not expanded in diameter, corresponds to a shank 4 for an automobile arm.

The upsetting apparatus 1C executes upsetting of each of the diameter expansion scheduled portions 2 and 2 of the axial both side portions of the raw material 1, and is equipped with a fixed die 10, two guides 20 and 20, two punches 30 and 30, two guide driving apparatus 40 and 40, and two punch driving apparatus 50 and 50.

In the same manner as in the second embodiment, the fixed die 10 has a raw material fixing insertion hole 11 extended in the axial direction of the fixed die 10 in a penetrated manner.

Moreover, the fixed die 10 has, at its axial both end portions, molding dented portions 12 each for forming the corresponding diameter expansion scheduled portion 2 of the raw material 1 into a designed shape (i.e., a circular disc shape).

Moreover, the opening edge portion of each insertion hole 11 of the fixed die 10 is chamfered along the entire periphery thereof, and the cross-sectional shape of this edge is formed into a round shape. "11*a*" denotes a chamfered portion formed on the edge portion.

Each guide 20 has an insertion hole 21 in the same manner as in the second embodiment.

The opening edge portion of the insertion hole 21 of the tip end portion 20*a* of each guide 20 is chamfered. "21*a*" denotes the chamfered portion formed on the edge portion.

Furthermore, diameter expansion preventing protruded portions 22 and 22 protruded from the guide 20 in the axial direction are integrally formed at a pair of opposed portions of the tip end portion 20*a* of each guide 20. In this embodiment, protruded portions 22 and 22 are integrally formed at thickness direction both side portions of the tip end portion 20*a* of each guide 20.

On the other hand, at a pair of opposed portions of the peripheral surface 12*a* of each molding dented portion 12 of the fixed die 10 as a molding surface, slide groove portions 13 and 13 for slidably inserting each protruded portion 22 of the corresponding guide 20 extending in the axial direction of the fixed die 10 are formed. In this embodiment, a slide groove portion 13 is formed in each thickness direction side portion of the peripheral surface 12*a* of each molding dented portion 12 of the fixed die 10. Furthermore, the fixed die 10 has a slide hole portion 14 extended in the axial direction of the fixed die 10 so as to continue from each slide groove portion 13.

The side surface 22*a* of the protruded portion 22 of each guide 20 is formed into a surface corresponding to the peripheral surface of the diameter expanded portion 3 of the raw material 1. Therefore, the side surface 22*a* of each protruded portion 22 is formed so as to be flush with the peripheral surface 12*a* of the corresponding molding dented portion 12 in the peripheral direction in the state in which the protruded portion 22 is inserted in the corresponding slide groove portion 13. In this embodiment, the side surface 22*a* of each protruded portion 22 is formed into a flat surface corresponding to the peripheral surface of the corresponding circular disc-like diameter expanded portion 3.

Each punch 30, each punch driving apparatus 50 and each guide driving apparatus 40 are the same as the second embodiment in structure.

The upsetting method using the upsetting apparatus 1C of the aforementioned third embodiment is the same as the second embodiment, and therefore the explanation will be omitted. In this third embodiment, each diameter expansion scheduled portion 2 of the raw material 1 will be formed into a circular disc shape.

In the upsetting method of the third embodiment, by moving each guide 20 in a direction 25 opposite to the moving direction 35 of the corresponding punch 30 while simultaneously pressurizing each diameter expansion scheduled portion 2 of the raw material 1 by the corresponding punch 30 in the axial direction, both the diameter expansion scheduled portions 2 and 2 of the raw material 1 are simultaneously expanded in diameter. Therefore, a preform for an automobile arm (upsetting manufactured product 6C) having diameter expanded portions 3 and 3 at axial both side portions can be manufactured efficiently.

FIGS. 15 to 18 are schematic views for explaining an upsetting method using the upsetting apparatus according to a fourth embodiment of the present invention.

Figure 15:
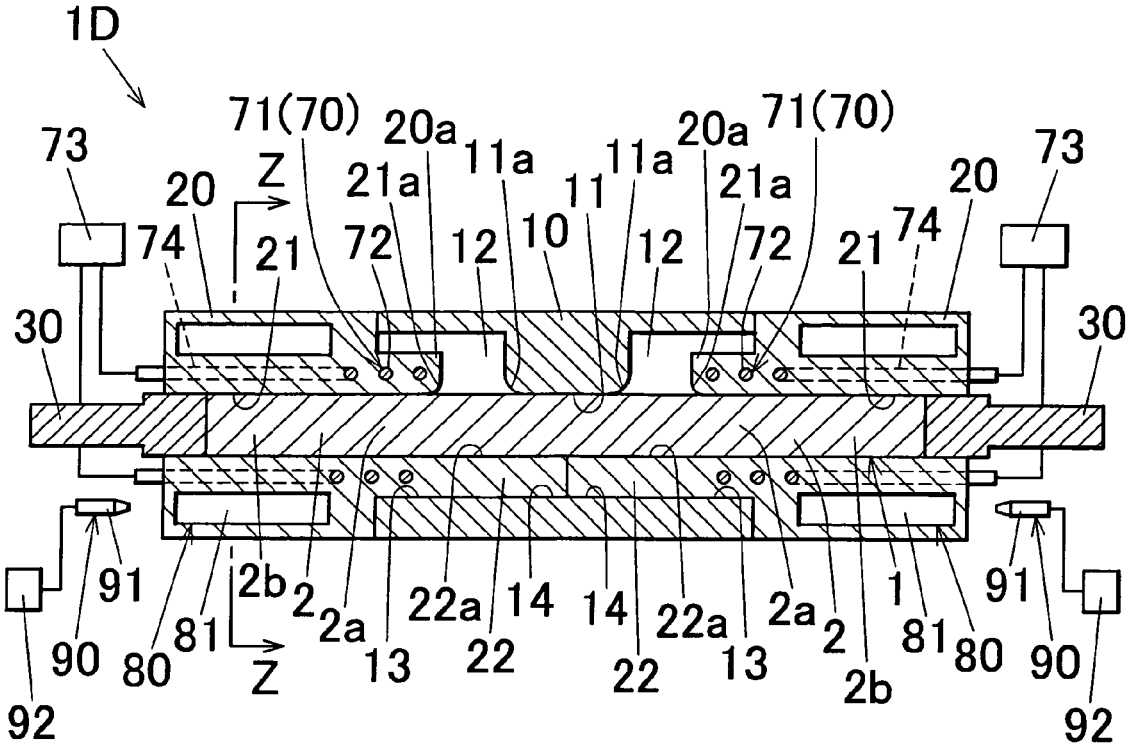
FIG. 15 is a cross-sectional perspective view of the upsetting apparatus showing the state before expanding the diameter expansion scheduled portion of the raw material by the upsetting apparatus according to a fourth embodiment of the present invention.

In FIG. 15, "1D" denotes an upsetting apparatus according to the fourth embodiment. In FIG. 15, the same reference mark is given to the same component as the component of the upsetting apparatus 1B of the second embodiment shown in FIG. 6A to FIG. 9. Hereafter, the structure of the upsetting apparatus 1D according to the fourth embodiment will be explained focusing on the points different from the upsetting apparatus 1B of the second embodiment in structure.

The upsetting manufactured product manufactured by the upsetting apparatus 1D of the fourth embodiment is the same as the upsetting manufactured product 6B shown in FIG. 9.

In this fourth embodiment, the raw material 1 is a round bar-shaped material, more specifically, a solid round bar-shaped material. This raw material 1 is a rolled material, and is obtained by being rolled with reduction rolls into a round bar-shape. That is, this raw material 1 is a raw material obtained by roll forming. In detail, this raw material 1 is a cast rolled material, more specifically, a continuously cast rolled material manufactured by a known Properzi method. In this present invention, however, the rolled material is not limited to a continuously cast rolled material manufactured by the Properzi method, but can be any rolled material manufactured by the other methods.

The cast rolled material denotes a cast manufactured by rolling a cast material. In this case, as the cast, a cast obtained by a known casting method, such as, e.g., a one-way solidification casting, can be used.

Figure 16:
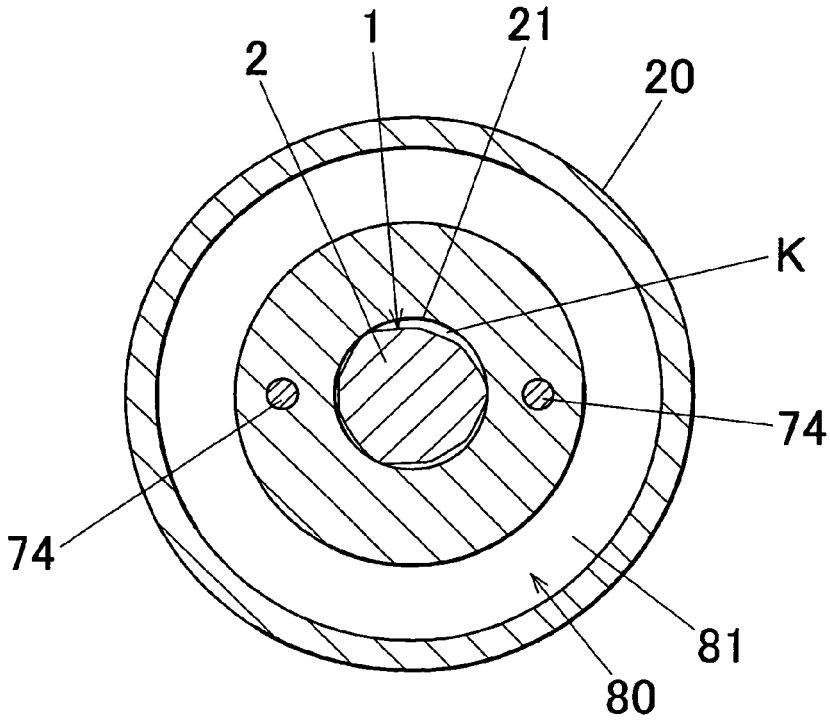
FIG. 16 is a cross-sectional view taken along the line Z-Z in FIG. 15.
Figure 17:
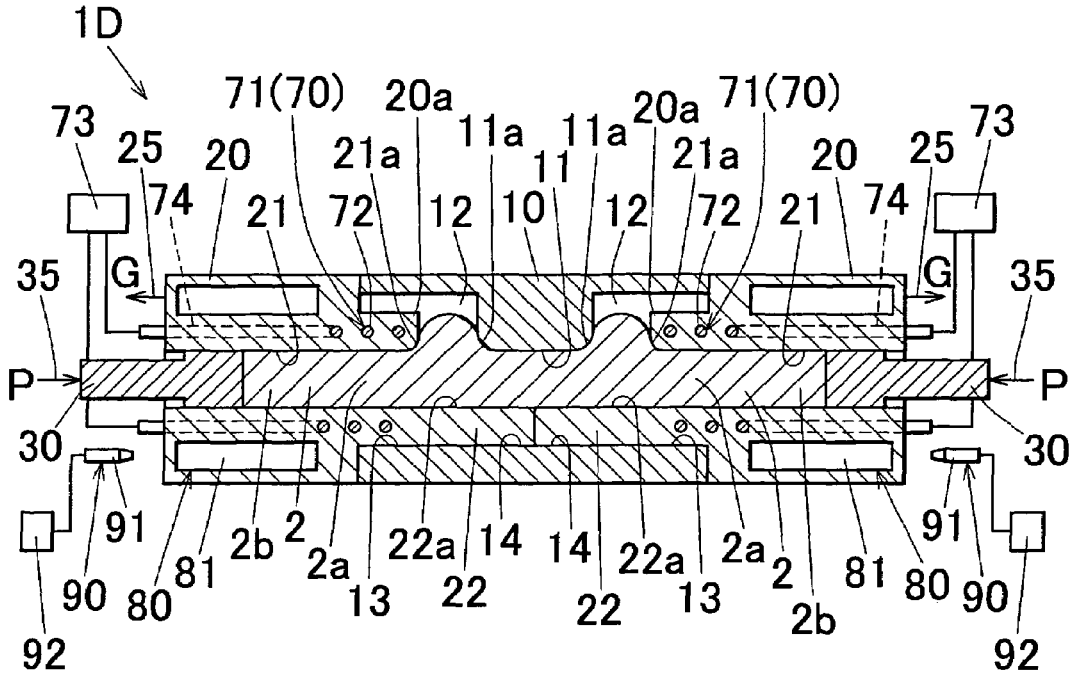
FIG. 17 is a cross-sectional perspective view of the upsetting apparatus showing the state in which the diameter expansion scheduled portion of the raw material is being expanded by the upsetting apparatus.
Figure 18:
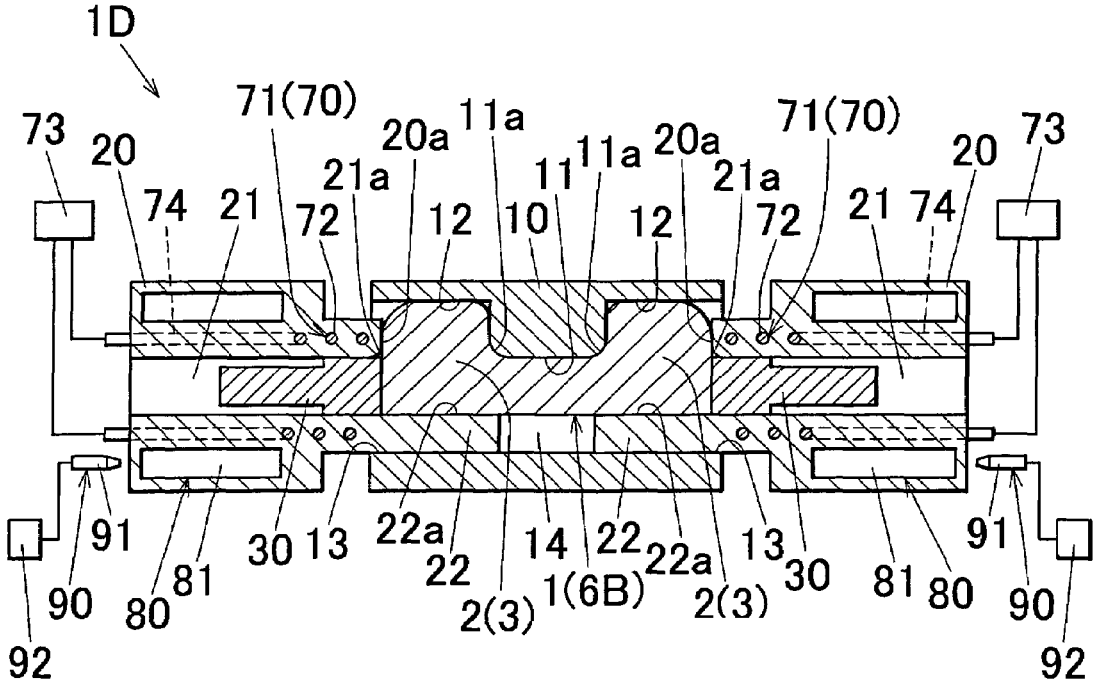
FIG. 18 is a cross-sectional perspective view of the upsetting apparatus showing the state after expanding the diameter expansion scheduled portion of the raw material by the upsetting apparatus.

As mentioned above, this raw material 1 is a round bar-shaped material, i.e., the raw material 1 is round (approximately round) in cross-section. As shown in FIG. 16, however, the raw material 1 is hexagonal or more polygonal in cross-section when observed in an enlarged manner. Therefore, the circularity of this raw material 1 is poor as compared with a raw material which is a round bar-shaped extruded material.

As shown in FIG. 15, the upsetting apparatus 1D of the fourth embodiment is provided with all of the structure elements of the upsetting apparatus 1B of the second embodiment (see FIG. 6A to FIG. 9), and further provided with two heating means 70 and 70, two cooling means 80 and 80, and two lubricant applying means 90 and 90.

As shown in FIG. 16, the cross-sectional shape of the insertion hole 21 of each guide 20 is circular. The circularity of this insertion hole 21 is set to be higher than the circularity of the cross-section of the diameter expansion scheduled portion 2 of the raw material 1. Moreover, the diameter of this insertion hole 21 is set to be the same as or slightly larger than the maximum diameter of the diameter expansion scheduled portion 2 of the raw material 1. Therefore, as shown in FIG. 16, in the state in which the diameter expansion scheduled portion 2 of the raw material 1 is inserted into the insertion hole 21, a gap K is slightly generated inevitably between the surface (peripheral surface) of the diameter expansion scheduled portion 2 and the peripheral surface of the insertion hole 21.

The two heating means 70 and 70 are the same in structure. Each heating means 70 is configured to partially heat the part 2*a* of each diameter expansion scheduled portion 2 of the raw material 1 corresponding to the tip end portion 20*a* of the guide 20. The heating means 70 is an induction-heating means 71 having an induction-heating coil 72 and a power-supply portion 73 for supplying supplies AC current (or AC voltage) to the coil 72. "74" denotes a lead wire connecting the power supply portion 73 and the induction-heating coil 72.

The surface of the induction-heating coil 72 are covered by an insulating layer (not shown), such as, e.g., an insulating tape. Furthermore, this coil 72 is disposed so as to surround the insertion hole 21 at the tip end portion 20*a* of the guide 20. More specifically, it is embedded in the tip end portion 20*a* of the guide 20.

The guide 20 and its tip end portion 20*a* is made of a hard non-conductivity material having heat resistance, such as, e.g., ceramics, or made of a hard conductive material (e.g., heat-resistant metal material) having heat resistance, such as, e.g., steel materials.

In this induction-heating means 71, it is configured such that the portion 2*a* of the diameter expansion scheduled portion 2 of the raw material 1 corresponding to the tip end portion 20*a* of the guide 20 is partially induction-heated by the coil 72 when a current (voltage) of a prescribed frequency (high frequency, low frequency, etc.) is supplied to the coil 72 by the power supply portion 73. Furthermore, this induction-heating means 71 is configured such that a prescribed portion 2*a* of the raw material 1 is partially heated into a half-molten state by raising the induction heating temperature by increasing, e.g., the current supplying amount, etc., to the coil 72.

The two cooling means 80 and 80 are the same in structure. Each cooling means 80 cools the portion 2*b* of each diameter expansion scheduled portion 2 of the raw material 1 corresponding to the portion nearer the basal end side of the guide 20 than the tip end portion 20*a*. This cooling means 80 has a cooling fluid passage 81 formed in the portion nearer the basal end side portion of the guide 20 than the tip end portion 20*a* of the guide 20. It is configured such that a prescribed portion 2*b* of the raw material 1 is cooled by circulating cooling fluid, such as, e.g., cooling water, in the cooling fluid passage 81.

The two lubricant applying means 90 and 90 are the same in structure. Each lubricant applying means 90 makes the lubricant adhere to the peripheral surface of the insertion hole 21 of the guide 20.

In the present invention, however, each lubricant applying means 90 also can be a means for making lubricant adhere to the surface of the diameter expansion scheduled portion 2 of the raw material 1, or a means for making lubricant adhere to both the peripheral surface of the insertion hole 21 of the guide 20 and the surface of the diameter expansion scheduled portion 2 of the raw material 1.

The lubricant is for reducing the frictional resistance between the surface of the diameter expansion scheduled portion 2 of the raw material 1 and the peripheral surface of the insertion hole 21. As this lubricant, for example, fluid lubrication, such as, e.g., oily lubricant, can be used. More specifically, "Oildag" (trade name) made by Acheson (Japan) Limited and "Dafni dina draw" (trade name) made by Idemitsu Kosan Co., Ltd., or the like, can be used.

The lubricant applying means 90 has a nozzle 91 for spraying lubricant and a lubricant supplying portion 92 for supplying lubricant to the nozzle 91. It is configured to make the lubricant spay and adhere to the peripheral surface of the insertion hole 21 by spouting the lubricant from the nozzle 91.

Next, the upsetting method using the upsetting apparatus 1D of this fourth embodiment will be explained below.

First, the lubricant is spouted from the nozzle 91 of the lubricant applying means 90 towards the peripheral surface of the insertion hole 21 of each guide 20 to thereby spray the lubricant to and make the lubricant adhere to the approximately entire peripheral surface of the insertion hole 21. The lubricant can be sprayed to the surface of each diameter expansion scheduled portion 2 of the raw material 1 to make the lubricant adhere thereto.

Subsequently, as shown in FIG. 15, the raw material 1 is secured to the fixed die 10 so as not to unintentionally move in the axial direction by fitting the axial intermediate portion of the raw material 1 as a non-diameter-expansion scheduled portion in the raw material fixing insertion hole 11 of the fixed die 10. Thus, each diameter expansion scheduled portion 2 of the raw material 1 is placed in the corresponding molding dented portion 12.

Furthermore, each diameter expansion scheduled portion 2 of the raw material 1 is inserted in the corresponding insertion hole 21 of the guide 20 to be held in a buckling preventing state in an axially slidable manner. And the protruded portion 22 of each guide 20 is inserted in the corresponding slide groove portion 13 and slide hole portion 14. In this state, as shown in FIG. 16, the lubricant adhering to the peripheral surface of the insertion hole 21 is introduced into the gap K between the surface of each diameter expansion scheduled portion 2 of the raw material 1 and the peripheral surface of the insertion hole 21 of each guide 20, and the lubricant is temporarily retained in the gap K.

Current of a prescribed frequency is supplied to the coil 72 of each induction-heating means 71 by the power-supply portion 73 to thereby partially induction-heat the portion 2*a* of each diameter expansion scheduled portion 2 of the raw material 1 corresponding to the tip end portion 20*a* of the guide 20 at a prescribed temperature. Thereby, the deformation resistance in the portion 2*a* of the raw material 1 reduces partially.

This heating temperature can be any temperature so long as the deformation resistance of the prescribed portion 2*a* of the raw material 1 can be reduced, and is not limited to a specific temperature. A preferable concrete heating temperature can be exemplified as follows.

For example, in cases where the material of the raw material 1 is aluminum or aluminum alloy, the preferable heating temperature falls within the range of, for example, 200 to 580° C. (more preferably 350 to 540° C.). Furthermore, in cases where the prescribed portion 2*a* of the raw material 1 is heated into a half-molten state, the preferable heating temperature falls within the range of, for example, 580 to 625° C. (more preferably 600 to 615° C.). However, it should be noted that in the present invention the heating temperature is not limited to the aforementioned ranges.

Furthermore, the portion 2*b* of each diameter expansion scheduled portion 2 of the raw material 1 corresponding to a portion of the guide 20 nearer the basal end side than the tip end portion 20*a* is partially cooled by circulating cooling fluid, such as, e.g., cooling water, of normal temperature in the cooling fluid passage 81 of each cooling means 80. This restrains the deterioration of the deformation resistance of each portion 2*b* of the raw material 1.

The preferable cooling temperature falls within the range of, for example, 30 to 80° C. (more preferably 40 to 60° C.). In the present invention, however, the cooling temperature is not limited to the aforementioned ranges.

Subsequently, while maintaining this state, in the same procedures as in the upsetting method explained in the second embodiment, both the diameter expansion scheduled portions 2 and 2 of the raw material 1 are simultaneously expanded in diameter within the molding dented portions 12 and 12.

Subsequently, the raw material 1 is taken out of the fixed die 10 to thereby obtain the predetermined upsetting manufactured product 1B as shown in FIG. 9.

In this upsetting method, it is preferable that the average moving speed G of each guide 20 from the moving initiation satisfies the equation (i).

Thus, the upsetting method of the fourth embodiment has the following advantages in addition to the advantages of the upsetting method of the second embodiment.

That is, since the raw material 1 is a round bar-shaped rolled material, the raw material 1 can be obtained or manufactured at low cost. This results in reduced working cost.

Furthermore, since the raw material 1 is a cast rolled material, the raw material 1 can be obtained or manufactured at lower cost. This results in further reduced working cost. Furthermore, since the raw material 1 is a continuity cast rolled material manufactured by a Properzi method, the raw material 1 can be obtained or manufactured at still further reduced cost. This results in further reduced working cost.

Therefore, according to the upsetting method of the fourth embodiment, a cheap upsetting manufactured product can be provided.

Furthermore, this raw material 1 is low in circularity as compared with a round bar-shaped extruded raw material. Therefore, when the diameter expansion scheduled portion 2 of this raw material 1 is inserted in the insertion hole 21 of the guide 20, a gap K will be inevitably generated between the surface of the diameter expansion scheduled portion 2 of the raw material 1 and the peripheral surface of the insertion hole 21. Therefore, since the contact area of them is small and therefore the frictional-resistance force at the time of the diameter expansion scheduled portion 2 of the raw material 1 is slidably moved in the axial direction in the insertion hole 21 is small, resulting in a reduced molding pressure. Consequently, a smaller punch driving apparatus 50 (see FIG. 6A) for moving the punch 30 can be used, which in turn can reduce the installation space for the upsetting apparatus 1D.

Furthermore, since molding pressure can be reduced, there are following advantages. That is, if the molding pressure is large, the end portion of the diameter expansion scheduled portion 2 of the raw material 1 is often crushed in the insertion hole 21 of the guide 20 by the pressing force by the punch 30. In such case, some material of the diameter expansion scheduled portion 2 of the raw material 1 is introduced into the gap between the peripheral surface of the punch 30 and the peripheral surface of the insertion hole 21. This results in an increased molding pressure, which in turn makes it impossible for the punch 30 to move in the pressing direction in the insertion hole 21, resulting in unworkable. Then, reducing the molding pressure can prevent occurrence of such problem, which in turn can execute the upsetting of the raw material 1 along a long region.

The adhering of the lubricant on the peripheral surface of the insertion hole 21 of the guide 20 brings the following advantages. That is, as mentioned above, since the gap K is generated between the surface of the diameter expansion scheduled portion 2 of the raw material 1 and the peripheral surface of the insertion hole 21, the lubricant adhering to the peripheral surface of the insertion hole 21 (or the surface of the diameter expansion scheduled portion 2 of the raw material 1) is introduced into the gap K, and the lubricant is temporarily retained in the gap K. This enhances the applying of the lubricant to the peripheral surface of the insertion hole 21 and the surface of the diameter expansion scheduled portion 2 of the raw material 1. That is, in accordance with the axial slide movement of the diameter expansion scheduled portion 2 of the raw material 1 in the insertion hole 21 at the time of working, the lubricant retained in the gap K is applied to the peripheral surface of the insertion hole 21 and the surface of the diameter expansion scheduled portion 2 of the raw material 1. This assuredly can reduce the frictional-resistance force between the peripheral surface of the insertion hole 21 and the surface of the diameter expansion scheduled portion 2 of the raw material 1, namely, the molding pressure can be reduced assuredly.

Furthermore, the partial induction heating of the portion 2*a* of each diameter expansion scheduled portion 2 of the raw material 1 corresponding to the tip end portion 20*a* of the guide 20 causes a partial reduction of the deformation resistance of only the portion 2*a* of each diameter expansion scheduled portion 2 of the raw material 1 corresponding to the tip end portion 20*a* of the guide 20. This enables further reduction of molding pressure.

On the other hand, the portion 2*b* of each diameter expansion scheduled portion 2 of the raw material 1 corresponding to the portion nearer the basal end side of the guide 20 than the tip end portion 20*a* of the guide 20 is not heated, and therefore the deformation resistance is not reduced. Therefore, it becomes possible to prevent an increase in molding pressure due to the radially outward expansion of the diameter expansion scheduled portion 2 of the raw material 1 in the insertion hole 21 of the guide 20 by the pressure of the punch 30. Furthermore, it also becomes possible to prevent an increase in molding pressure due to the introduction of some material of the diameter expansion scheduled portion 2 of the raw material 1 in the gap between the peripheral surface of the punch 30 and the peripheral surface of the insertion hole 21. Therefore, molding pressure can be reduced assuredly even in the case of a long diameter expansion scheduled portion 2 of the raw material 1 as well as a short diameter expansion scheduled portion 2.

Furthermore, since the prescribed portion 2*a* of the raw material 1 is induction-heated by the induction-heating coil 72 placed in the tip end portion 20*a* of the guide 20, the prescribed portion 2*a* of the raw material 1 can be heated assuredly and very efficiently.

Furthermore, in the present invention, the prescribed portion 2*a* of the raw material 1 can be partially heated into a half-molten state by raising the heating temperature. In this case, molding pressure can be reduced considerably. The upsetting in this case can be classified under a category of Thixomolding.

Furthermore, by partially cooling the portion 2*b* of each diameter expansion scheduled portion 2 of the raw material 1 corresponding to a portion nearer the basal end side of the guide 20 than the tip end portion 20*a* of the guide 20 by the cooling means 80, it becomes possible to assuredly prevent the heating of the portion 2*b* of the raw material 1. Consequently, deterioration of the deformation resistance at the portion 2*b* of the raw material 1 can be restrained assuredly.

In the fourth embodiment, the portion 2*a* of each diameter expansion scheduled portion 2 of the raw material 1 corresponding to the tip end portion 20*a* of the guide 20 is partially induction-heated by the induction-heating means 71. In the present invention, however, in place of the above, for example, the tip end portion 20*a* of each guide 20 can be partially introduction-heated by the coil 72 of the induction-heating means 71 to thereby partially heat the portion 2*a* of each diameter expansion scheduled portion 2 of the raw material 1 corresponding to the tip end portion 20*a* of the guide 20 by the heat of the tip end portion 20*a* of the guide 20. That is, the heat of the tip end portion 20*a* of the guide 20 is conducted to the portion 2*a* of the raw material 1 to thereby partially heat the portion 2*a* of the raw material 1. In this case, the portion 2*a* of the raw material 1 can be heated assuredly and efficiently. Moreover, in this case, the tip end portion 20*a* of the guide 20 is preferably made of conductive material (e.g., heat-resistant metal material) having heat resistance, such as, e.g., steel material.

Although some embodiments of the present invention were explained above, the present invention is not limited to one of them, and can be changed variously.

For example, the upsetting apparatus according to the present invention is not limited to an apparatus for manufacturing a preform for a double-headed piston of a compressor or a preform for an arm of an automobile, and can be used to manufacture preforms for various industrial products, such as, e.g., a preform for connecting rods, or a preform for crankshafts.

Moreover, in the present invention, it can be configured such that the diameter expansion scheduled portion of the raw material is located at the axial intermediate portion of the raw material, so that a diameter expanded portion is formed at the axial intermediate portion of the raw material by expanding the diameter expansion scheduled portion by the upsetting method according to the present invention.

Furthermore, in the present invention, the diameter expansion preventing protruded portion 22 can be formed at one place of the tip end portion 20*a* of the guide 20 or at two or more places (for example, 2 to 10 places) of the tip end portion 20*a* of the guide 20.

Furthermore, in the present invention, the diameter expansion scheduled portion of the raw material can be expanded in diameter with the raw material heated at a prescribed temperature or with the raw material not heated. That is, the upsetting method of the present invention can be a hot upsetting method or a cold upsetting method.

In addition, in the present invention, the fixed die 10 and the guide 20 can be a member divided into plural parts. The number and position of the division of the fixed die 10 and the guide 20 can be variously set according to the shape of the upsetting manufactured product.

EXAMPLES

Next, concrete examples of the present invention are shown below. However, the present invention is not limited to the following examples.

A round bar-shaped raw material 1 made of a continuously cast rolled material having a diameter of 12 mm manufactured by a Properzi method, and a round bar-shaped raw material 1 made of an extruded material having a diameter of 12 mm were prepared. The material of each of the raw materials 1 is a JIS (Japanese Industrial Standards) A6061 aluminum alloy. These raw materials 1 were subjected to upsetting using the upsetting apparatus 1D of the fourth embodiment. The molding pressure required at the upsetting was checked. The results are shown in Table 1. The length of each diameter expansion scheduled portion 2 of the raw material 1 was 200 mm.

TABLE 1

| | Type of raw material | Heating mode | Heating temperature | Cooling | Molding pressure |
|---|---|---|---|---|---|
| Example 1 | Rolled material | Partial heating | 500° C. | Yes | $4.3 \times 10^7$ Pa |
| Example 2 | Rolled material | Entire heating | 400° C. | No | $6.7 \times 10^8$ Pa |
| Example 3 | Extruded material | Partial heating | 500° C. | Yes | $8.0 \times 10^7$ Pa |
| Example 4 | Extruded material | Entire heating | 400° C. | No | $8.0 \times 10^8$ Pa |

Here, in the "heating mode" in Table 1, "Partial heating" denotes the case where the portion 2*a* of each diameter expansion scheduled portion 2 of the raw material 1 corresponding to the tip end portion 20*a* of the guide 20 is partially induction-heated by the induction-heating coil 72. On the other hand, "entire heating" denotes the case where the entire raw material 1 was heated in a heating furnace, and then this raw material 1 in a heated state was quickly set in the upsetting apparatus 1D and then upsetting was performed.

In the "Cooling" column, "Yes" denotes the case where cooling fluid was flowed in the cooling fluid passage 81 of each guide 20 to thereby cool the portion 2*b* of each diameter expansion scheduled portion 2 of the raw material 1 corresponding to the portion nearer the basal end side than the tip end portion 20*a* of the guide 20. "No" denotes the case where no cooling was performed.

As shown in Table 1, in the case where the raw material 1 made of continuously cast rolled material was used (Examples 1 and 2), the molding pressure could be reduced as compared with the case where the raw material 1 made of extruded material was used (Examples 3 and 4).

Furthermore, in the case where a partial heating was performed (Examples 1 and 3), the molding pressure could be reduced as compared with the case where entire heating was performed (Examples 2 and 4).

It should be understood that the terms and expressions used herein are used for explanation and have no intention to be used to construe in a limited manner, do not eliminate any equivalents of features shown and mentioned herein, and allow various modifications falling within the claimed scope of the present invention.

INDUSTRIAL APPLICABILITY

The present invention can be applied an upsetting method and an upsetting apparatus capable of expanding the diameter expansion scheduled portion of the raw material unevenly in the peripheral direction.

What is claimed is:

1. An upsetting method using an upsetting apparatus provided with a fixed die for securing a bar-shaped raw material, a guide having an insertion hole for receiving and holding a diameter expansion scheduled portion of the raw material in a buckling preventing state, and a punch, wherein a diameter expansion preventing protruded portion protruded in an axial direction of the guide is integrally formed at a part of a tip end portion of the guide, the method comprises:

inserting and holding the diameter expansion scheduled portion of the raw material secured to the fixed die in the insertion hole of the guide; and subsequently expanding the diameter expansion scheduled portion of the raw material exposed between the tip end portion of the guide and the fixed die in a state in which diameter expansion of a contacting portion of the diameter expansion scheduled portion in contact with the diameter expansion preventing protruded portion is restrained by moving the guide in a direction opposite to a moving direction of the punch while moving the punch and pressurizing the diameter expansion scheduled portion of the raw material with the punch in an axial direction thereof such that expansion of the raw material is prevented at the part of the tip end portion of the guide having the expansion prevention protruded portion, but not prevented at other parts of the tip end portion of the guide.

2. An upsetting method using an upsetting apparatus provided with a fixed die for securing a bar-shaped raw material, a guide having an insertion hole for receiving and holding a diameter expansion scheduled portion of the raw material in a buckling preventing state, and a punch, wherein a diameter expansion preventing protruded portion protruded in an axial direction of the guide is integrally formed at a part of a tip end portion of the guide, the method comprises:

inserting and holding the diameter expansion scheduled portion of the raw material secured to the fixed die in the insertion hole of the guide; and subsequently expanding the diameter expansion scheduled portion of the raw material exposed between the tip end portion of the guide and the fixed die in a state in which diameter expansion of a contacting portion of the diameter expansion scheduled portion in contact with the diameter expansion preventing protruded portion is restrained by moving the guide in a direction opposite to a moving direction of the punch while moving the punch and pressurizing the diameter expansion scheduled portion of the raw material with the punch in an axial direction thereof, wherein the fixed die is provided with a molding dented portion and a slide groove portion to be slidably inserted by the diameter expansion preventing protruded portion of the guide in an axial direction of the fixed die, the slide groove portion being formed on a peripheral surface of the molding dented portion extended in the axial direction of the fixed die, wherein a side surface of the protruded portion of the guide with which a part of a peripheral surface of the diameter expansion scheduled portion of the raw material comes into contact is formed into a surface corresponding to a peripheral surface of a diameter expanded portion of the raw material, wherein the diameter expansion scheduled portion of the raw material secured to the fixed die is placed in the molding dented portion, the diameter expansion scheduled portion of the raw material is inserted and held in the insertion hole of the guide, and the protruded portion of the guide is inserted in the slide groove portion, and wherein the diameter expansion scheduled portion of the raw material is subsequently expanded in the molding dented portion.

3. The upsetting method as recited in claim 1, wherein said moving the guide comprises moving the guide at an average moving speed "G" from initiation of the moving, which satisfies the following equation (i), $$G=(X_g-X)P/(L_0-X_P-Pt_0) \quad \text{(i)}$$

where "P" denotes an average moving speed of the punch from moving initiation thereof, "$X_0$" denotes a buckling limit length at a cross-sectional area of the diameter expansion scheduled portion of the raw material before executing the upsetting, "X" denotes an initial clearance between the tip end portion of the guide and the fixed die ($0 \leqq X \leqq X_0$), "$L_0$" denotes a length of the raw material before executing the upsetting required for a diameter expanded portion, "$X_P$" denotes a stop position of the tip end portion of the punch with respect to the fixed die, which is obtained from a design volume of the diameter expanded portion, "$X_g$" denotes a designed stop position of the tip end portion of the guide with respect to the fixed die, and "$t_0$" denotes a time lag from the moving initiation of the punch to the moving initiation of the guide ($0 \leqq t_0$).

4. The upsetting method as recited in claim 1, wherein the diameter expansion scheduled portion of the raw material comprises two diameter expansion scheduled portions located at opposing axial portions of the raw material, and wherein each diameter expansion scheduled portion of the raw material secured to the fixed die is inserted and held in the insertion hole of a respective one of said guides, and thereafter both of the diameter expansion scheduled portions of the raw material are simultaneously expanded in diameter by moving each guide in a direction opposite to the moving direction of a corresponding punch while simultaneously pressurizing each diameter expansion scheduled portion of the raw material with each corresponding punch in the axial direction.

5. The upsetting method as recited in claim 1, wherein an insertion hole opening edge portion of the tip end portion of the guide is chamfered.

6. The upsetting method as recited in claim 1, wherein an opening edge portion of a raw material fixing insertion hole formed at the fixed die is chamfered.

7. The upsetting method as recited in claim 1, wherein the raw material is a round bar-shaped rolled material.

8. The upsetting method as recited in claim 7, wherein the raw material is a cast rolled material.

9. The upsetting method as recited in claim 7, wherein the raw material is a continuously cast rolled material.

10. The upsetting method as recited in claim 7, wherein the diameter expansion scheduled portion of the raw material is expanded in diameter in a state in which lubricant is applied to a peripheral surface of the insertion hole of the guide and/or a surface of the diameter expansion scheduled portion of the raw material.

11. The upsetting method as recited in claim 1, wherein the diameter expansion scheduled portion of the raw material is expanded in diameter in a state in which a portion of the diameter expansion scheduled portion of the raw material corresponding to the tip end portion of the guide is partially heated.

12. The upsetting method as recited in claim 11, wherein the portion of the diameter expansion scheduled portion of the raw material corresponding to the tip end portion of the guide is partially induction-heated by induction-heating means.

13. The upsetting method as recited in claim 11, wherein the portion of the diameter expansion scheduled portion of the raw material corresponding to the tip end portion of the guide is partially heated by partially induction-heating the tip end portion of the guide by induction-heating means.

14. The upsetting method as recited in claim 11, wherein the portion of the diameter expansion scheduled portion of the raw material corresponding to the tip end portion of the guide is partially heated into a half-molten state.

15. An upsetting method using an upsetting apparatus provided with a fixed die for securing a bar-shaped raw material, a guide having an insertion hole for receiving and holding a diameter expansion scheduled portion of the raw material in a buckling preventing state, and a punch, wherein a diameter expansion preventing protruded portion protruded in an axial direction of the guide is integrally formed at a part of a tip end portion of the guide, the method comprises:

inserting and holding the diameter expansion scheduled portion of the raw material secured to the fixed die in the insertion hole of the guide; and subsequently expanding the diameter expansion scheduled portion of the raw material exposed between the tip end portion of the guide and the fixed die in a state in which diameter expansion of a contacting portion of the diameter expansion scheduled portion in contact with the diameter expansion preventing protruded portion is restrained by moving the guide in a direction opposite to a moving direction of the punch while moving the punch and pressurizing the diameter expansion scheduled portion of the raw material with the punch in an axial direction thereof, wherein the diameter expansion scheduled portion of the raw material is expanded in diameter in a state in which a portion of the diameter expansion scheduled portion of the raw material corresponding to the tip end portion of the guide is partially heated, wherein the diameter expansion scheduled portion of the raw material is expanded in diameter in a state in which a portion of the diameter expansion scheduled portion of the raw material corresponding to a portion of the guide nearer the basal end side of the guide than the tip end portion of the guide by cooling means.

16. An upsetting manufactured product obtained by the upsetting method as recited in claim 1.

* * * * *